US009422797B2

(12) United States Patent
Ware et al.

(10) Patent No.: US 9,422,797 B2
(45) Date of Patent: Aug. 23, 2016

(54) METHOD OF RECOVERING HYDROCARBONS FROM A RESERVOIR

(71) Applicant: World Energy Systems Incorporated, Fort Worth, TX (US)

(72) Inventors: Charles H. Ware, Palm Harbor, FL (US); Blair A. Folsom, Santa Ana, CA (US)

(73) Assignee: WORLD ENERGY SYSTEMS INCORPORATED, Fort Worth, TX (US)

( * ) Notice: Subject to any disclaimer, the term of this patent is extended or adjusted under 35 U.S.C. 154(b) by 174 days.

(21) Appl. No.: 14/203,181

(22) Filed: Mar. 10, 2014

(65) Prior Publication Data

US 2014/0231078 A1 Aug. 21, 2014

Related U.S. Application Data

(63) Continuation of application No. 13/768,872, filed on Feb. 15, 2013, now Pat. No. 8,678,086, which is a continuation of application No. 12/836,991, filed on Jul. 15, 2010, now Pat. No. 8,387,692.

(60) Provisional application No. 61/226,642, filed on Jul. 17, 2009, provisional application No. 61/226,650, filed on Jul. 17, 2009.

(51) Int. Cl.
*E21B 36/02* (2006.01)
*E21B 43/24* (2006.01)

(52) U.S. Cl.
CPC ..... *E21B 43/24* (2013.01); *E21B 36/02* (2013.01); *Y10T 137/0318* (2015.04); *Y10T 137/8593* (2015.04)

(58) Field of Classification Search
CPC ..... E21B 43/164; E21B 43/166; E21B 43/24; E21B 43/243
See application file for complete search history.

(56) References Cited

U.S. PATENT DOCUMENTS 3,456,721 A 7/1969 Smith
3,700,035 A 10/1972 Lange (Continued)

FOREIGN PATENT DOCUMENTS

CN 2358341 Y 1/2000
CN 2409334 Y 12/2000

(Continued)

OTHER PUBLICATIONS

Chinese Office Action for Chinese Application No. 2010/80032416.1 mailed Nov. 25, 2013.

(Continued)

*Primary Examiner* — William P Neuder
(74) *Attorney, Agent, or Firm* — Patterson & Sheridan, L.L.P.

(57) ABSTRACT

A downhole steam generation apparatus and method of use are provided. The apparatus may include an injection section, a combustion section, and an evaporation section. The injection section may include a housing, injector elements, and injector plate. The combustion section may include a liner having channels disposed therethrough. The evaporation section may include conduits in fluid communication with the channels and the combustion chamber, and a nozzle operable to inject a fluid from the channels to the combustion chamber in droplet form. A method of use may include supplying fuel, oxidant, and fluid to the apparatus; combusting fuel and oxidant in a chamber while flowing the fluid through a plurality of channels disposed through a liner, thereby heating the fluid and cooling the liner; and injecting droplets of the heated fluid into the chamber and evaporating the droplets by combustion of the fuel and the oxidant to produce steam.

13 Claims, 20 Drawing Sheets

(56) References Cited

U.S. PATENT DOCUMENTS

| | | | | |
|---|---|---|---|---|
| 3,980,137 | A | 9/1976 | Gray | |
| 3,982,591 | A | 9/1976 | Hamrick et al. | |
| 3,982,592 | A | 9/1976 | Hamrick et al. | |
| 4,024,912 | A | 5/1977 | Hamrick et al. | |
| 4,026,357 | A * | 5/1977 | Redford | E21B 43/40 166/261 |
| 4,050,515 | A | 9/1977 | Hamrick et al. | |
| 4,077,469 | A | 3/1978 | Hamrick et al. | |
| 4,078,613 | A | 3/1978 | Hamrick et al. | |
| 4,118,925 | A | 10/1978 | Sperry et al. | |
| 4,159,743 | A | 7/1979 | Rose et al. | |
| 4,199,024 | A | 4/1980 | Rose et al. | |
| 4,244,684 | A | 1/1981 | Sperry et al. | |
| 4,336,839 | A | 6/1982 | Wagner et al. | |
| 4,366,860 | A | 1/1983 | Donaldson et al. | |
| 4,380,267 | A | 4/1983 | Fox | |
| 4,385,661 | A | 5/1983 | Fox | |
| 4,411,618 | A | 10/1983 | Donaldson et al. | |
| 4,421,163 | A | 12/1983 | Tuttle | |
| 4,442,898 | A | 4/1984 | Wyatt | |
| 4,456,068 | A | 6/1984 | Burrill, Jr. et al. | |
| 4,459,101 | A | 7/1984 | Doherty | |
| 4,463,803 | A | 8/1984 | Wyatt | |
| 4,475,883 | A | 10/1984 | Schirmer et al. | |
| 4,498,531 | A | 2/1985 | Vrolyk | |
| 4,498,542 | A | 2/1985 | Eisenhawer et al. | |
| 4,558,743 | A | 12/1985 | Ryan et al. | |
| 4,597,441 | A | 7/1986 | Ware et al. | |
| 4,604,988 | A | 8/1986 | Rao | |
| 4,648,435 | A | 3/1987 | Beckerer, Jr. et al. | |
| 4,648,835 | A | 3/1987 | Eisenhawer et al. | |
| 4,678,039 | A | 7/1987 | Rivas et al. | |
| 4,682,471 | A | 7/1987 | Wagner | |
| 4,691,771 | A | 9/1987 | Ware et al. | |
| 4,706,751 | A | 11/1987 | Gondouin | |
| 4,765,406 | A | 8/1988 | Frohling et al. | |
| 4,860,827 | A | 8/1989 | Lee et al. | |
| 4,861,263 | A | 8/1989 | Schirmer | |
| 4,865,130 | A | 9/1989 | Ware et al. | |
| 4,930,454 | A | 6/1990 | Latty et al. | |
| 5,055,030 | A | 10/1991 | Schirmer | |
| 5,163,511 | A | 11/1992 | Amundson et al. | |
| 5,412,981 | A | 5/1995 | Myers et al. | |
| 5,488,990 | A | 2/1996 | Wadleigh et al. | |
| 5,623,576 | A | 4/1997 | Deans | |
| 5,832,999 | A | 11/1998 | Ellwood | |
| 5,862,858 | A | 1/1999 | Wellington et al. | |
| 5,899,269 | A | 5/1999 | Wellington et al. | |
| 6,016,867 | A | 1/2000 | Gregoli et al. | |
| 6,016,868 | A | 1/2000 | Gregoli et al. | |
| 6,019,172 | A | 2/2000 | Wellington et al. | |
| 6,269,882 | B1 | 8/2001 | Wellington et al. | |
| 6,328,104 | B1 | 12/2001 | Graue | |
| 6,358,040 | B1 | 3/2002 | Pfefferle et al. | |
| 6,394,791 | B2 | 5/2002 | Smith et al. | |
| 6,752,623 | B2 | 6/2004 | Smith et al. | |
| 6,973,968 | B2 | 12/2005 | Pfefferle | |
| 7,090,013 | B2 | 8/2006 | Wellington | |
| 7,114,566 | B2 | 10/2006 | Vinegar et al. | |
| 7,341,102 | B2 | 3/2008 | Kresnyak et al. | |
| 7,343,971 | B2 | 3/2008 | Pfefferle | |
| 7,497,253 | B2 | 3/2009 | Retallick et al. | |
| 7,712,528 | B2 | 5/2010 | Langdon et al. | |
| 7,770,646 | B2 | 8/2010 | Klassen et al. | |
| 8,091,625 | B2 | 1/2012 | Ware et al. | |
| 8,387,692 | B2 | 3/2013 | Tilmont et al. | |
| 8,678,086 | B2 | 3/2014 | Tilmont et al. | |
| 2003/0175082 | A1 | 9/2003 | Liebert et al. | |
| 2004/0050070 | A1 | 3/2004 | Sprouse et al. | |
| 2005/0061506 | A1 | 3/2005 | Grove et al. | |
| 2005/0239661 | A1 | 10/2005 | Pfefferle | |
| 2006/0042794 | A1 | 3/2006 | Pfefferle | |
| 2006/0142149 | A1 | 6/2006 | Ma et al. | |
| 2006/0162923 | A1 | 7/2006 | Ware | |
| 2006/0254956 | A1 | 11/2006 | Khan | |
| 2006/0289157 | A1 | 12/2006 | Rao | |
| 2007/0039736 | A1 | 2/2007 | Kalman et al. | |
| 2007/0202452 | A1 | 8/2007 | Rao | |
| 2007/0202453 | A1 | 8/2007 | Knoepfel | |
| 2007/0284107 | A1 * | 12/2007 | Crichlow | E21B 43/166 166/302 |
| 2008/0017381 | A1 | 1/2008 | Baiton | |
| 2008/0078552 | A1 | 4/2008 | Donnelly et al. | |
| 2008/0083537 | A1 * | 4/2008 | Klassen | E21B 43/164 166/302 |
| 2008/0135241 | A1 * | 6/2008 | Iqbal | F22B 1/22 166/266 |
| 2011/0036095 | A1 | 2/2011 | Krajicek | |
| 2011/0214858 | A1 | 9/2011 | Castrogiovanni et al. | |

FOREIGN PATENT DOCUMENTS

| | | | |
|---|---|---|---|
| CN | 201053311 | Y | 4/2008 |
| RU | 2087802 | C1 | 8/1997 |
| RU | 2115065 | C1 | 7/1998 |
| RU | 2226646 | C2 | 4/2004 |
| RU | 2316648 | C1 | 2/2008 |
| SU | 76100 | A1 | 1/1949 |

OTHER PUBLICATIONS

PCT Search and Written Opinion for International Application No. PCT/US2010/042190 dated Feb. 28, 2011.

V. Graifer, et al., Bottom-hole Formation Zone Treatment Using Monofuel Thermolysis, SPE 138077, 2010 SPE Russian Oil & Gas Technical Conference and Exhibition held in Moscow, Russia on Oct. 26, 2010, 3 Pages.

* cited by examiner

METHOD OF RECOVERING HYDROCARBONS FROM A RESERVOIR

CROSS REFERENCE TO RELATED APPLICATIONS

This application is a continuation of U.S. application Ser. No. 13/768,872, filed Feb. 15, 2013, which is a continuation of U.S. application Ser. No. 12/836,992, filed Jul. 15, 2010, now U.S. Pat. No. 8,387,692, which claims benefit of U.S. Application Ser. No. 61/226,642, filed Jul. 17, 2009, and U.S. Application Ser. No. 61/226,650, filed Jul. 17, 2009, which are herein incorporated by reference in their entirety.

BACKGROUND OF THE INVENTION

1. Field of the Invention

Embodiments of the invention relate to downhole steam generators.

2. Description of the Related Art

There are extensive viscous hydrocarbon reservoirs throughout the world. These reservoirs contain a very viscous hydrocarbon, often called "bitumen," "tar," "heavy oil," or "ultra heavy oil," (collectively referred to herein as "heavy oil") which typically has viscosities in the range from 3,000 to over 1,000,000 centipoise. The high viscosity makes it difficult and expensive to recover the hydrocarbon.

Each oil reservoir is unique and responds differently to the variety of methods employed to recover the hydrocarbons therein. Generally, heating the heavy oil in situ to lower the viscosity has been employed. Normally reservoirs as viscous as these would be produced with methods such as cyclic steam stimulation (CSS), steam drive (Drive), and steam assisted gravity drainage (SAGD), where steam is injected from the surface into the reservoir to heat the oil and reduce its viscosity enough for production. However, some of these viscous hydrocarbon reservoirs are located under a permafrost layer that may extend as deep as 1800 feet. Steam cannot be injected though the permafrost layer because the heat could potentially expand the permafrost, causing wellbore stability issues and significant environmental problems with melting permafrost.

Additionally, the current methods of producing heavy oil reservoirs face other limitations. One such problem is wellbore heat loss of the steam, as the steams travels from the surface to the reservoir. This problem is worsened as the depth of the reservoir increases. Similarly, the quality of steam available for injection into the reservoir also decreases with increasing depth, and the steam quality available downhole at the point of injection is much lower than that generated at the surface. This situation lowers the energy efficiency of the oil recovery process.

To address the shortcomings of injecting steam from the surface, the use of downhole steam generators (DHSG) has been employed. DHSGs provide the ability to heat steam downhole, prior to injection into the reservoir. DHSGs, however, also present numerous challenges, including excessive temperatures, corrosion issues, and combustion instabilities. These challenges often result in material failures and thermal instabilities and inefficiencies.

Therefore, there is a continuous need for new and improved downhole steam generator designs.

SUMMARY OF THE INVENTION

Embodiments of the invention relate to a downhole steam generation apparatus. In one embodiment, a downhole steam generation apparatus for injecting a heated fluid mixture into a reservoir may include an injection section including a housing, an injector element disposed in the housing, and an injector plate coupled to the housing. The apparatus may include a combustion section including a body coupled to the housing and forming a combustion chamber, wherein the body includes a unitary annulus disposed therethrough. The apparatus may further include an evaporation section including a nozzle coupled to the body, wherein the nozzle is operable to inject fluid droplets into the combustion chamber in a direction away from the injection section.

In one embodiment, a method for injecting a heated fluid mixture into a reservoir may include positioning an apparatus in a wellbore, wherein the apparatus includes a liner having a chamber; supplying a fuel, an oxidant, and a fluid to the apparatus; combusting the fuel and the oxidant in the chamber while flowing the fluid through an annulus disposed through the liner, thereby heating the fluid and cooling the liner; injecting droplets of the heated fluid into the chamber co-flow to injection of the fuel and oxidant into the chamber; and evaporating the droplets by combustion of the fuel and the oxidant to produce steam.

In one embodiment, a method for injecting a heated fluid mixture into a reservoir may include supplying a first fluid and a second fluid to an injector body; injecting the first fluid and the second fluid from the injector body to a combustion chamber for combustion of the first and second fluids, wherein the combustion section includes a chamber, a liner surrounding the chamber, and a unitary annulus disposed through the liner; supplying a third fluid through the unitary annulus of the liner, thereby cooling the liner; heating the fluid supplied through the unitary annulus by combustion of the first and second fluids in the combustion chamber; injecting droplets of the heated fluid from the unitary annulus into the combustion chamber in a direction parallel to the flow of the first and second fluids, thereby evaporating the droplets; injecting the combusted first and second fluids and the evaporated droplets into the reservoir; and injecting a nanocatalyst into the reservoir.

In one embodiment, a downhole steam generation apparatus for injecting a heated fluid mixture into a reservoir may include an injection section having a housing, an injector element disposed in the housing, and an injector plate coupled to the housing. The apparatus may include a combustion section having a body coupled to the housing that forms a combustion chamber. The body may include a unitary annulus disposed therethrough. The apparatus may include an evaporation section having a nozzle coupled to the body. The nozzle is operable to inject fluid droplets into the combustion chamber in a direction away from the injection section.

The unitary annulus may be in fluid communication with the nozzle. The evaporation section may further include a conduit coupled to the nozzle and the body. The unitary annulus may be in fluid communication with the nozzle via the conduit. The nozzle may be operable to inject fluid droplets into the combustion chamber in a direction radially outward toward the body.

In one embodiment, a method for injecting a heated fluid mixture into a reservoir may comprise positioning an apparatus in a wellbore, wherein the apparatus includes a liner having a chamber; supplying a fuel, an oxidant, and a fluid to the apparatus; combusting the fuel and the oxidant in the chamber while flowing the fluid through an annulus disposed through the liner, thereby heating the fluid and cooling the liner; injecting droplets of the heated fluid into the chamber co-flow to injection of the fuel and oxidant into the chamber; and evaporating the droplets by combustion of the fuel and the oxidant to produce steam.

The fuel may include at least one of synthesis gas and hydrogen, and the oxidant may include at least one of dioxide, pure oxygen, and enriched air. The method may further comprise flowing the heated fluid through a conduit that radially extends into the chamber. The method may further comprise injecting droplets of the heated fluid into the chamber using a nozzle coupled to the conduit. The steam may include superheated steam.

In one embodiment, a method for injecting a heated fluid mixture into a reservoir may comprise supplying a first fluid and a second fluid to an injector body; injecting the first fluid and the second fluid from the injector body to a combustion chamber for combustion of the first and second fluids, wherein the combustion section includes a chamber, a liner surrounding the chamber, and a unitary annulus disposed through the liner; supplying a third fluid through the unitary annulus of the liner, thereby cooling the liner; heating the fluid supplied through the unitary annulus by combustion of the first and second fluids in the combustion chamber; injecting droplets of the heated fluid from the unitary annulus into the combustion chamber in a direction parallel to the flow of the first and second fluids, thereby evaporating the droplets; injecting the combusted first and second fluids and the evaporated droplets into the reservoir; and injecting a nanocatalyst into the reservoir.

The first fluid may be an oxidant comprising at least one of dioxide, pure oxygen, and enriched air. The second fluid may be a fuel comprising at least one of synthesis gas and hydrogen. The method may further comprise generating superheated steam by evaporation of the droplets. The method may further comprise recovering gas hydrates from the reservoir. The method may further comprise upgrading hydrocarbons disposed in the reservoir using the combusted first and second fluids, the evaporated droplets, and the nanocatalyst injected into the reservoir. The nanocatalyst may be injected into the reservoir simultaneously with the combusted first and second fluids and the evaporated droplets.

In one embodiment, a method of optimizing a burner located in a wellbore may comprise supplying a fuel and an oxidant to the burner; combusting the fuel and the oxidant, thereby forming a combustion flame; and controlling a size, a shape, and an intensity of the flame to optimize the burner based on wellbore conditions.

In one embodiment, a method of selecting combustion chamber parameters including but not limited to length, diameter and number may be provided to optimize heat transfer to the walls and optimize complete combustion.

In one embodiment, a method of selecting water injector parameters including the number, design, droplet size distribution and spray geometry may be provided to avoid flame quenching, complete evaporation in a distance commensurate with the application requirements, provide wall wetting to avoid overheating and minimize deposit formations on the walls of the combustion chamber and downstream components.

In one embodiment, a method of controlling heat transfer in a burner may comprise providing a burner having an injector head and a combustion chamber; combusting reactants in the combustion chamber; supplying water through one or more cooling passages disposed in the walls of the combustion chamber; and varying one or more of: reactants in the burner, injector head design, combustion chamber geometry, water flow rate, fluid velocity swirl and turbulence, cooling passage geometry, number of cooling passages, wall characteristics to induce turbulence, inserts in the cooling passages, and direction of flow within the cooling passages, to thereby minimize the formation of at least one of steam and gas bubbles in the cooling passages of the combustion chamber.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to an apparatus and method of use of a downhole steam generator (DHSG). As set forth herein, embodiments of the invention will be described as they relate to a DHSG and heavy oil reservoirs. It is to be noted, however, that aspects of the invention are not limited to use with a DHSG, but are applicable to other types of systems, such as other downhole mixing devices. It is to be further noted, however, that aspects of the invention are not limited to use in the recovery of heavy oil, but are applicable to use in the recovery of other types of products, such as gas hydrates. To better understand the novelty of the apparatus of the invention and the methods of use thereof, reference is hereafter made to the accompanying drawings.

Figure 1:
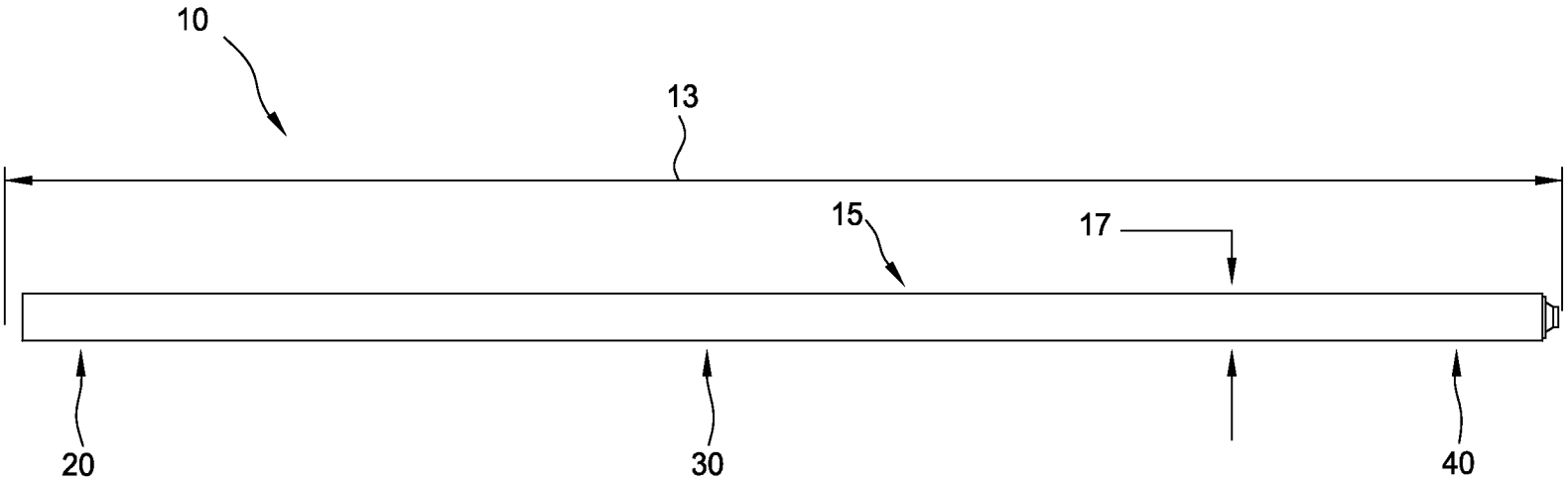
FIG. 1 illustrates a side view of a downhole steam generator according to one embodiment of the invention.

FIG. 1 illustrates a DHSG 10 according to one embodiment. The DHSG 10 may be utilized with various and multiple wellbore configurations, including vertical, horizontal, or combinations thereof. In addition, the DHSG 10 may be operable with various enhanced oil recovery methods, including cyclic steam stimulation (CSS), steam drive (Drive), steam assisted gravity drainage (SAGD), carbon dioxide ($CO_2$) flooding, or combinations thereof. The DHSG 10 may be configured to produce a range of products so as to optimize recovery of hydrocarbons and gas hydrates based on the specific wellbore and reservoir characteristics for one or more reservoirs. The DHSG 10 may be operable at wellbore depths of about 100 feet to about 500 feet; 500 feet to about 2500 feet; about 2500 feet to about 5000 feet; and/or about 5000 feet to greater than about 8000 feet.

In operation, the DHSG 10 is operable to generate heat within a heavy oil reservoir by burning a fuel and an oxidant supplied from the surface. The viscosity of heavy oil in the reservoir may be reduced by injecting one or more fluids and/or solvents, including but not limited to, water, partially or fully saturated steam, superheated steam, oxygen, air, rich air, natural gas, carbon dioxide, carbon monoxide, methane, nitrogen, hydrogen, hydrocarbons, oxygenated-hydrocarbons, or combinations thereof, using the DHSG 10 or separately from the DHSG 10, into the reservoir. In one embodiment, one or more of these fluids may be combusted in the DHSG 10 to produce a stream of heated water, partially or fully saturated steam, or superheated steam, which may also include carbon dioxide, carbon monoxide, natural gas, methane, nitrogen, hydrogen, hydrocarbons, oxygenated-hydrocarbons, air, rich air, and/or oxygen, and which will be injected into the reservoir. In one embodiment, nanocatalysts may also be dispersed into the reservoir independently or in combination with the combustion products injected into the reservoir using the DHSG to further facilitate recovery of hydrocarbons. In one embodiment, nanocatalysts may be injected into the reservoir with the combustion products using the DHSG to further facilitate recovery of hydrocarbons. U.S. Pat. No. 7,712,528 and co-pending U.S. patent application Ser. No. 12/767,466 are herein incorporated by reference and describe exemplary embodiments of utilizing nanocatalysts for the recovery of hydrocarbons which may be used with the embodiments described herein. The heavy oil in the reservoir may then be recovered by a variety of ways known in the art, such as by gas lift.

To generate combustion, the DHSG 10 may utilize natural gas as a fuel. In one embodiment, the DHSG 10 may utilize an oxygen and carbon dioxide mixture as an oxidant. In one embodiment, the oxidant stream may include a small percentage of nitrogen, such as about 5 percent. In one embodiment, synthesis gas may be used as the fuel. In one embodiment, the oxidant may include dioxide. In one embodiment, a mixture of oxygen and nitrogen may be used as the oxidant. In one embodiment, any gaseous or liquid fuel may be used, which may include natural gas, synthesis gas, low BTU gas derived from coal or other fuels, such as hydrogen, etc. In one embodiment, the oxidant may be pure oxygen or oxygen diluted with other fluids, such as carbon dioxide, carbon monoxide, hydrogen, nitrogen, and/or steam. In one embodiment, the oxidant may be air or enriched air.

In one embodiment, the oxygen and carbon dioxide mixture may be used to help control combustion, particularly to control flame temperature and to avoid extremely high flame temperatures. This mixture may be mixed at the surface and supplied in a single conduit to the DHSG 10. In one embodiment, the fuel, the oxidant, and/or any other fluids, such as water, may be supplied by separate conduits to the DHSG 10 as will be further described below.

The DHSG 10 may be operable to adjust flame temperature by changing the concentration of diluents supplied to the flame. Any non-reacting diluent may be used to facilitate adjustment of the flame temperature when supplied separately to the DHSG 10 and/or mixed with either the fuel or oxidant streams or both. In one embodiment, the carbon dioxide flow rate to the DHSG 10 can be adjusted to control flame temperature. The carbon dioxide may be mixed with the fuel, the oxidant, or both. In one embodiment, a diluent such as argon may be supplied to the DHSG 10 separately and/or mixed with either the fuel or oxidant streams or both.

As illustrated in FIG. 1, the DHSG 10 includes a housing 15 defining a hollow sleeve that surrounds an injection section 20 at one end, an evaporation section 40 at an opposite end, a combustion section 30 disposed between the injection section 20 and the evaporation section 40. In one embodiment, the DHSG 10 may include a tailpipe 50 adjacent the evaporation section 40 (shown in FIG. 2). The DHSG 10 may be dimensioned to fit within standard wellbore casing. A length 13 of the DHSG 10 may include a range of about 72 inches to about 360 inches or longer. In one embodiment, the length 13 of the DHSG 10 is about 180 inches. An outer diameter 17 of the housing 15 of the DHSG 10 may include a range of about 4 inches to about 10 inches. In one embodiment, the outer diameter 17 of the housing 15 of the DHSG 10 is about 6 inches.

The DHSG 10 may be formed from corrosion resistant materials, for example, to avoid corrosion by sulfur compounds for the components exposed to flame and combustion products. Particular components of the DHSG 10 may be formed from metals, such as steel, copper, and cobalt, from metal alloys, such as stainless steel, nickel-copper, and ceramic dispersion coppers, and metal alloys from brands such as Monel, Inconel, and Haynes alloys. In one embodiment, Monel 400 or 500 may be used for the DHSG components exposed to gaseous oxygen. In one embodiment, Haynes 188, 230, and/or 556 may be used for the DHSG 10 components subjected to a corrosive environment. In one embodiment, the water exposed components of the DHSG 10 may be formed from copper alloys, OFHC, GlidCop, GRCop84, AMZirc, beryllium copper, high thermally conductive materials, and/or ductile materials. In one embodiment, the combustion and/or evaporation sections 30 and 40 of the DHSG 10 may be formed from cobalt alloys, Haynes 188, Alloy 25, creep resistant materials, corrosion resistant materials, and/or materials having high strength at high temperatures. Higher temperature metals may facilitate cooling of the DHSG 10, and increase its thermal control and efficiency, thereby reducing stresses in the DHSG 10 components caused by extreme temperatures and increasing conduction paths from the heated surfaces to the cooling channels, as described herein.

Figure 2:
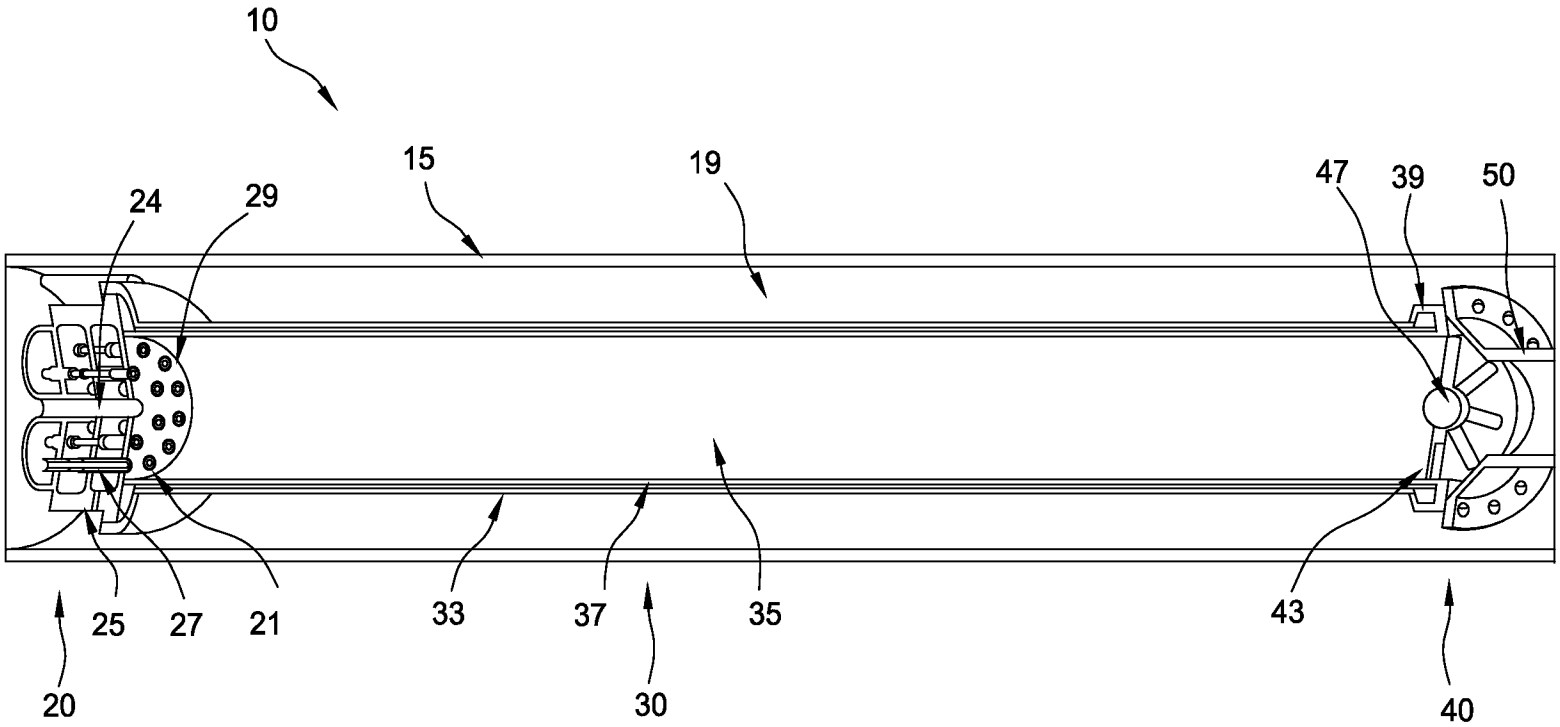
FIG. 2 illustrates a cross sectional view of the downhole steam generator according to one embodiment of the invention.

FIG. 2 illustrates a sectional view of the DHSG 10. As illustrated, the injection section 20 includes an injector body 25, such as a housing and further described with respect to FIG. 3, an igniter port 24, one or more injector elements 27, and one or more injector ports 21 located in an injector plate 29. The fuel and oxidant are supplied to the injector body 25, directed through the injector elements 27, and ignited by an igniter (not shown) as they exit the injector plate 29 into the combustion chamber 35. The igniter may provide the ignition necessary for combustion of the products injected into the combustion chamber 35 via the igniter port 24. The igniter may have the ability to ignite under startup conditions and provide repeat ignitions. In one embodiment, the ignition of the igniter may be provided with a pyrophoric material. In one embodiment, the ignition of the igniter may be by spark with a pyrophoric backup. In one embodiment, the DHSG 10 may alternatively include hot surface ignition to ignite the combustion products supplied to the DHSG 10. In one embodiment, the injection section 20 may be operable to maintain an adiabatic flame temperature in a range of about 3,200 degrees Fahrenheit to about 3,450 degrees Fahrenheit. In one embodiment, the injection section 20 may be operable to maintain an adiabatic flame temperature in a range of about 2,500 degrees Fahrenheit to about 5,500 degrees Fahrenheit. In one embodiment, the injection section 20 may be operable to maintain an adiabatic flame temperature in a range of about 3,000 degrees Fahrenheit to about 6,000 degrees Fahrenheit. In one embodiment, the injection section 20 may be operable to maintain an adiabatic flame temperature in a range of about 1,500 degrees Fahrenheit to about 7,000 degrees Fahrenheit.

The injector body 25 and the injector plate 29 are surrounded by the housing 15. The injector body 25 and/or the injector plate 29 may be coupled to a liner 33, such as a housing or body, of the combustion section 30. An annulus 19 may be formed between the housing 15 and the liner 33. The liner 33 may be formed from a single structural component. In one embodiment, the liner 33 may include multiple segments coupled together to form a single structure. In one embodiment, the liner 33 may include an inner diameter of about 3 inches. In one embodiment, the liner 33 may include an inner diameter in a range of about 2 inches to about 8 inches. At a first end, the liner 33 has a flanged end that is adapted to sealingly engage a lower portion of the injector body 25, such that fluids flowing through the injector elements 27 exit into the combustion chamber 35 of the liner 33. At a second end, the liner 33 may also have a flanged end that is in fluid communication with the evaporation section 40 and may be coupled to a tailpipe 50. In alternative embodiments, the ends of the liner 33 may include other means of connection to secure the components of the DHSG 10 together and with other downhole components to facilitate insertion into the wellbore. In one embodiment, the tailpipe 50 is integral with the housing 15. In one embodiment, the tailpipe 50 may be adapted to engage a downhole tool, such as a packer.

The liner 33 may further include an annular structure with a hollow body that forms the combustion chamber 35. The annular structure may have one or more holes or channels 37 circumferentially located about the wall of the annular structure, also surrounding the combustion chamber 35. The channels 37 extend the longitudinal length of the liner 33. In an alternative embodiment, the liner 33 may include a unitary annulus disposed through the body of the liner 33, surrounding the combustion chamber 35, and in fluid communication with the injection section 20 and the evaporation section 40, through which fluid may be directed. In an alternative embodiment, the liner 33 may include a narrow annulus having a spider portion or other similar device to help direct flow of fluids through the annulus. The spider portion may be placed over the inner wall of the liner and then the outer wall of the liner may be placed over the assembled inner wall and the spider portion, thereby forming one or more channels through the liner. In one embodiment, the channels 37 may include a circular shape. A fluid may enter an upper manifold in fluid communication with the channels 37 near the first end of the liner 33 adjacent the injection section 20 and may exit the channels 37 near the second end of the liner 33 adjacent the evaporation section 40. The channels 37 may empty into a lower manifold 39 disposed in the second end of the liner 33, which supplies the fluid to the evaporation section 40. In one embodiment, the lower manifold 39 may be disposed within the flanged end of the liner 33. As stated above, a similar manifold may be disposed in the first end of the liner 33, which supplies the fluid to the channels 37. In one embodiment, liquid water is supplied to the channels 37 of the liner 33, wherein the water is purified to less than one part per million of total dissolved solids. The chemistry of the liquid water may be controlled to prevent scaling in the channels 37 of the liner 33.

As energy or heat is generated and is released from the combustion reactions generated in the combustion chamber 35, the fluid supplied through the channels 37 of the liner 33 may act as a cooling agent and a heat transfer mechanism, to control and reduce the temperature of the liner 33. Fluids may be introduced into the channels 37 at its coolest temperature nearest the injection section 20 and the energy generated by the combustion reaction in the combustion chamber 35 may be used to heat the fluid as it travels through the channels 37 along the length of the liner 33 away from the injection section 20. In one embodiment, a fluid directed through the channels 37 of the liner 33 may be heated to a temperature below the boiling temperature of the fluid. In one embodiment, the DHSG 10 may be configured to heat fluid as it is directed through the channels 37 of the liner 33, while preventing steam generation in the channels 37. In one embodiment, fluid may alternately flow from a point furthest away from the injection section 20 to a point closest to the injection section to maintain temperature control of the liner 33.

The channels 37 of the liner 33 may be in communication with the evaporation section 40 via the lower manifold 39. The evaporation section 40 may include one or more conduits 43 that are in fluid communication with the manifold 39 of the liner 33. The conduits 43 may radially extend from the liner 33 and intersect at a compartment 47, which may be centrally located within the combustion chamber 35. The compartment 47 may be coupled to one or more nozzles 45 (shown in FIGS. 6 and 7) that are adapted to convert the fluid communicated to the compartment 47 from the lower manifold 39 into droplets of the fluid, for example, and inject these fluid droplets into the combustion chamber 35 in a direction that is counterflow to the flow of the combustion products. These fluid droplets may be evaporated by the combustion products in the combustion chamber 35 and exhausted from the DHSG 10 along with the combustion products into the heavy oil reservoir. In one embodiment, the evaporation section 40 may be coupled to the injection section 20 and/or the combustion section 30 in manner that the injection of the fluid droplets is into and/or downstream of the combustion chamber 35. In one embodiment, evaporation section 40 may be coupled to the injection section 20 and/or combustion section 30 in a manner that the injection of the fluid droplets may be counterflow, co-flow, and/or radial to the flow of the combustion products. In one embodiment, the evaporation section 40 may be operable to inject fluid droplets radially outward from the center of the combustion chamber 35 to the walls of the combustion chamber 35. The droplet injection parameters, including direction, velocity, size distribution, etc. may be optimized to produce the best balance of performance considering impacts on the combustion flame, liner wall wetting, evaporation distance, and liner wall cooling.

Figure 3:
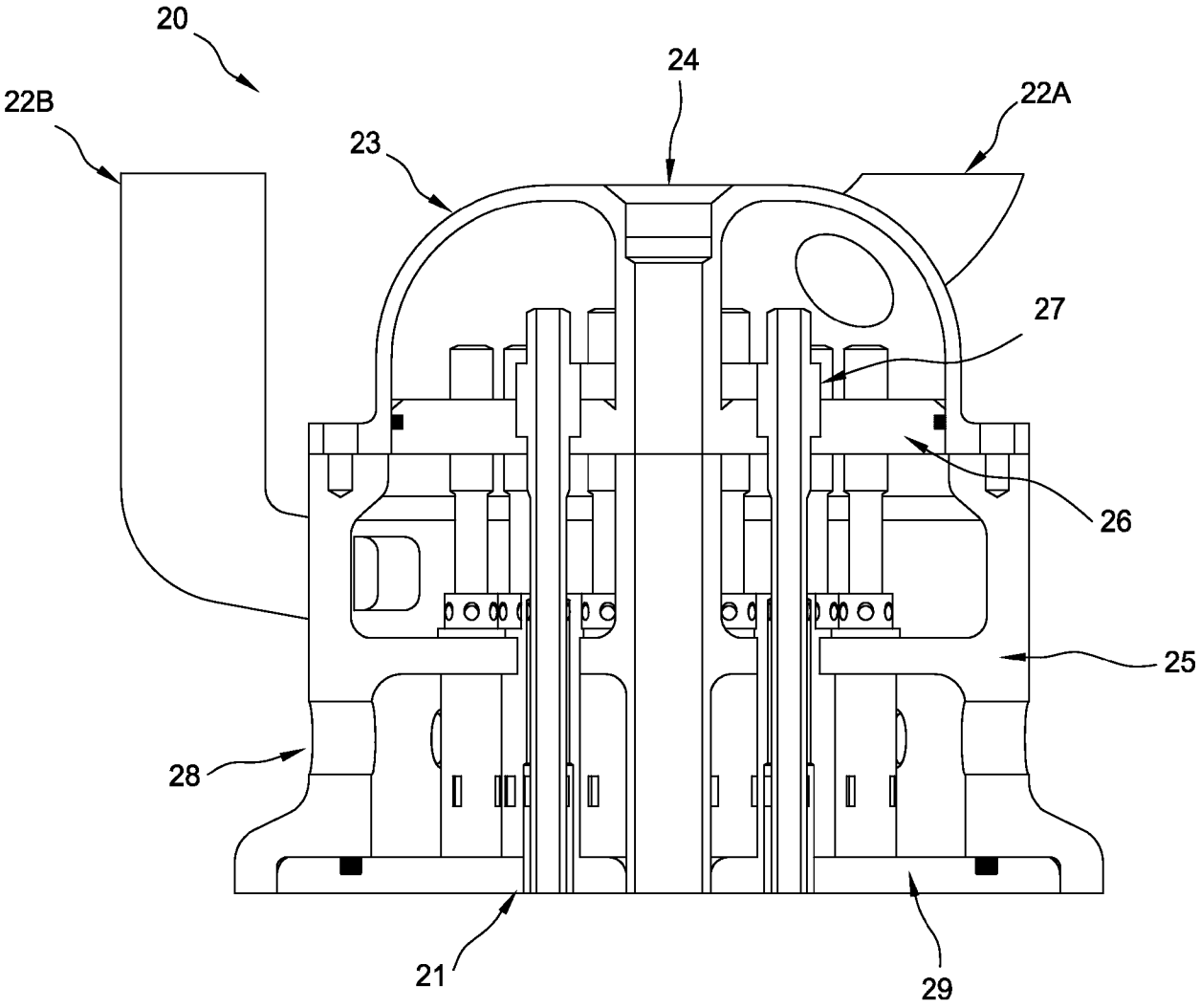
FIG. 3 illustrates a cross sectional view of an injector body according to one embodiment of the invention.

FIG. 3 illustrates one embodiment of the injector body 25. The injector body 25 may include a housing that is in fluid communication with the one or more supply lines for supplying combustion fluids to the DHSG 10 and is operable to direct the combustion fluids to the combustion chamber 35. The injector body 25 may also be operable to house the igniter and align the igniter with the igniter port 24. The injector body 25 includes an oxidant supply line 22A, a fuel supply line 22B, a top cover 23, and an inner plate 26. The oxidant may be supplied to a top plenum of the injection section 20, via the oxidant supply line 22A, through an opening in the top cover 23. The top cover 23 may include an arcuate roof having a substantially flat top surface, a flanged base, and a conduit extending from the roof to the base, thereby defining the igniter port 24. The igniter port 24 is disposed through the top cover 23 and extends through the injector body 25. The top cover 23 may sealingly engage the inner plate 26 as the top cover 23 is coupled to the injector body 25, thereby enclosing the top plenum. In one embodiment, the inner plate 26 may be integral with the top cover 23. In one embodiment, the flanged base of the top cover 23 may be bolted to the injector body 25. In one embodiment, injector body 25 may be cooled by passing a portion or all of a cooling fluid, such as liquid water, through passages in the injector body 25.

An intermediate plenum may be formed within the injector body 25 for receiving the fuel supplied from the fuel supply line 22B. The top cover 23 and the inner plate 26 may sealingly enclose the intermediate plenum. The fuel may be supplied to the intermediate plenum of the injector body 25, via the fuel supply line 22B, through an opening in the injector body 25. In an optional embodiment, a bottom plenum may optionally be formed within the injector body 25 for receiving one or more fluids, such as partially or fully saturated steam, water, carbon dioxide, or combinations thereof via one or more feed ports 28 for mixing with the fuel. In one embodiment, the one or more fluids may be used as cooling fluids to cool the components of the DHSG 10, such as the injection section 20 and/or combustion section 30. The injector plate 29 may be coupled to the base of the injector body 25, thereby sealingly enclosing the bottom plenum. In one embodiment, the injector plate 29 may be bolted to the injector body 25, as shown in FIG. 4.

The injector elements 27 may extend from the top plenum, through the intermediate and bottom plenums, and through the injector plate 29, such that the plenums are in fluid communication with the combustion chamber 35. The injector elements 27 may be coupled to the inner plate 26, the injector body 25, and the injector plate 29. The injector elements 27 may be configured to control mixing of the fuel, the oxidant, and/or any other fluid supplied through the injector elements 27 to control flame shape while achieving essentially complete combustion. The fluid mixing rates may be adjusted to control the size of the combustion flame.

Figure 4:
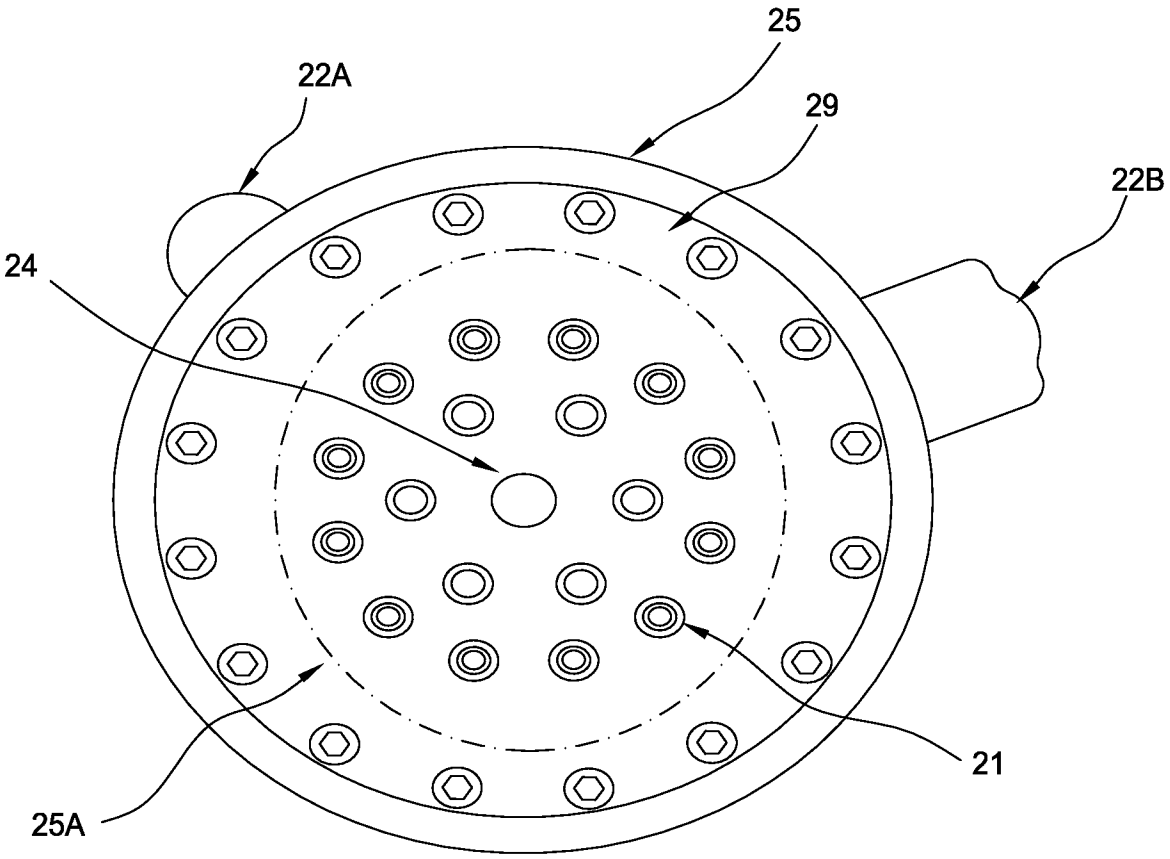
FIG. 4 illustrates a bottom view of an injector plate according to one embodiment of the invention.

FIG. 4 illustrates a bottom view of the injector plate 29. As illustrated, the injector elements 27 are disposed in concentric patterns around the igniter port 24 and extend through the injector ports 21 of the injector plate 29. The injector elements 27 may be positioned within a diameter 25*a*, as indicated by the dashed reference circle, which may define the inner diameter of the injector body 25. In one embodiment, the diameter 25*a* may be in a range of about 2 inches to about 5 inches. In one embodiment, the diameter 25*a* may be about 3 inches. In one embodiment, only a single injector element 27 may be configured for use with the DHSG 10.

Figure 5:
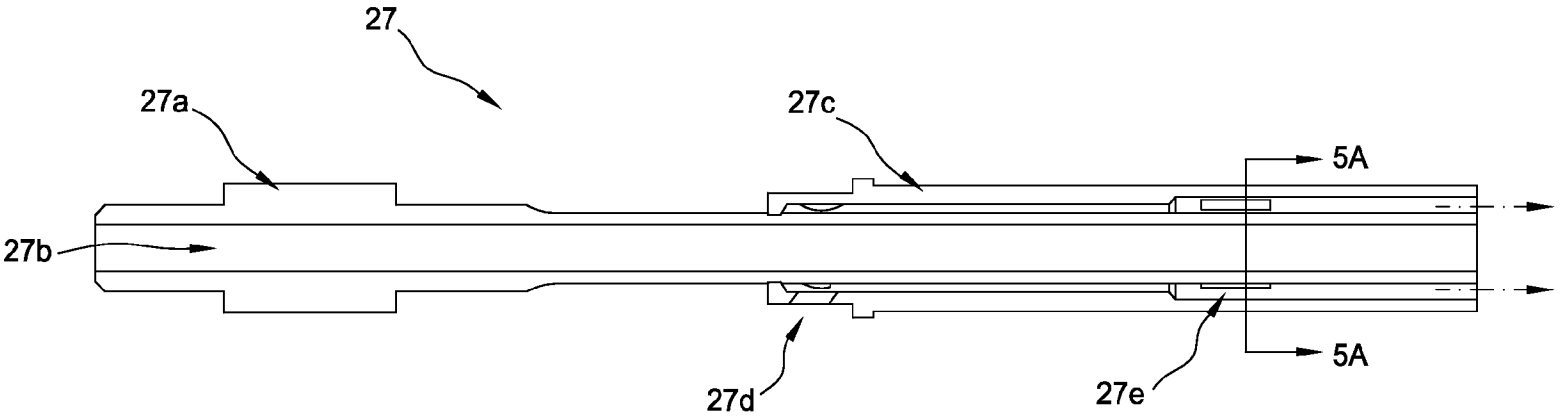
FIG. 5 illustrates a cross sectional view of an injector element according to one embodiment of the invention.
Figure 5A:
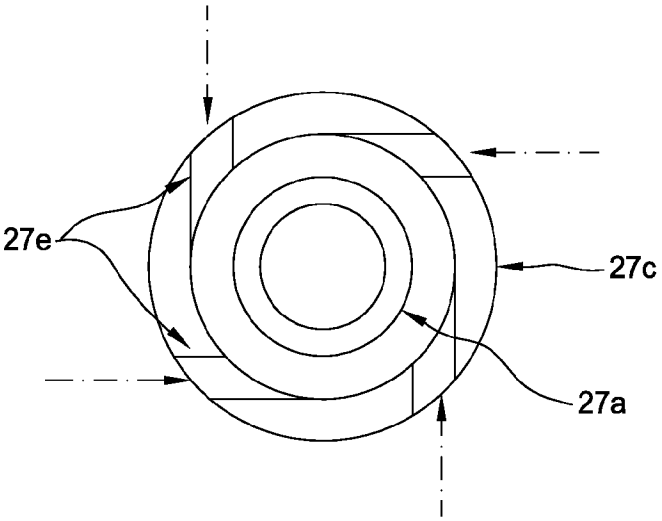
FIG. 5A illustrates a cross sectional top view of the injector element according to one embodiment of the invention.

FIG. 5 illustrates a cross sectional view of an injector element 27. The injector element 27 includes a body 27*a* and a sleeve 27*c*. The body 27*a* includes a top section that is coupled to the inner plate 26 (as shown in FIG. 3), and a channel 27*b* longitudinally disposed through the body 27*a* that exits at the injector plate 29 and is in fluid communication with the combustion chamber 35. The body 27*a* is coupled to the inner plate 26 so that the channel 27*b* is in fluid communication with the top plenum of the injector body 25. The sleeve 27*c* is coupled to and surrounds a portion of the body 27*a*, forming an annulus between the sleeve 27*c* and the body 27*a* that exits at the injector plate 29 and is in fluid communication with the combustion chamber 35. The sleeve 27*c* further includes one or more first ports 27*d* and optionally one or more second ports 27*e* if a bottom plenum is utilized. Both sets of ports 27*d* and 27*e* are disposed through the sleeve 27*c* and are in communication with the annulus formed between the sleeve 27*c* and the body 27*a* of the injector element 27. The first ports 27*d* are provided with an angled entrance, relative to the longitudinal axis of the injector element 27, into the annulus. The second ports 27*e* are provided with a tangential entrance, relative to the wall of the sleeve 27*c* (as shown in FIG. 5A) to generate a swirling effect of the entering fluids to facilitate efficient mixing of the reactants. The sleeve 27*c* is coupled to the injector body 25 so that the first ports 27*d* are in direct fluid communication with the intermediate plenum and the second ports 27*e* are in direct fluid communication with the third plenum (as shown in FIG. 3).

Figure 7:
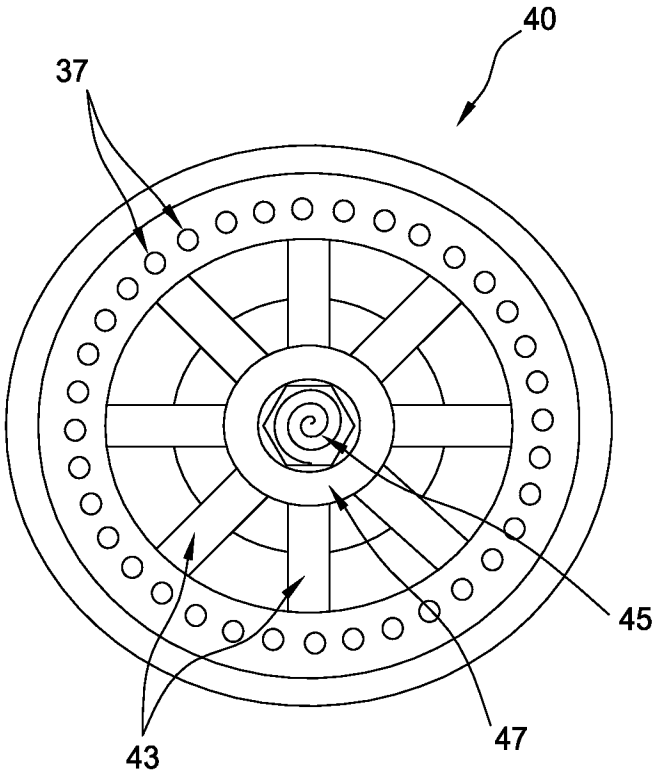
FIG. 7 illustrates a top view of the evaporation section according to one embodiment of the invention.
Figure 6:
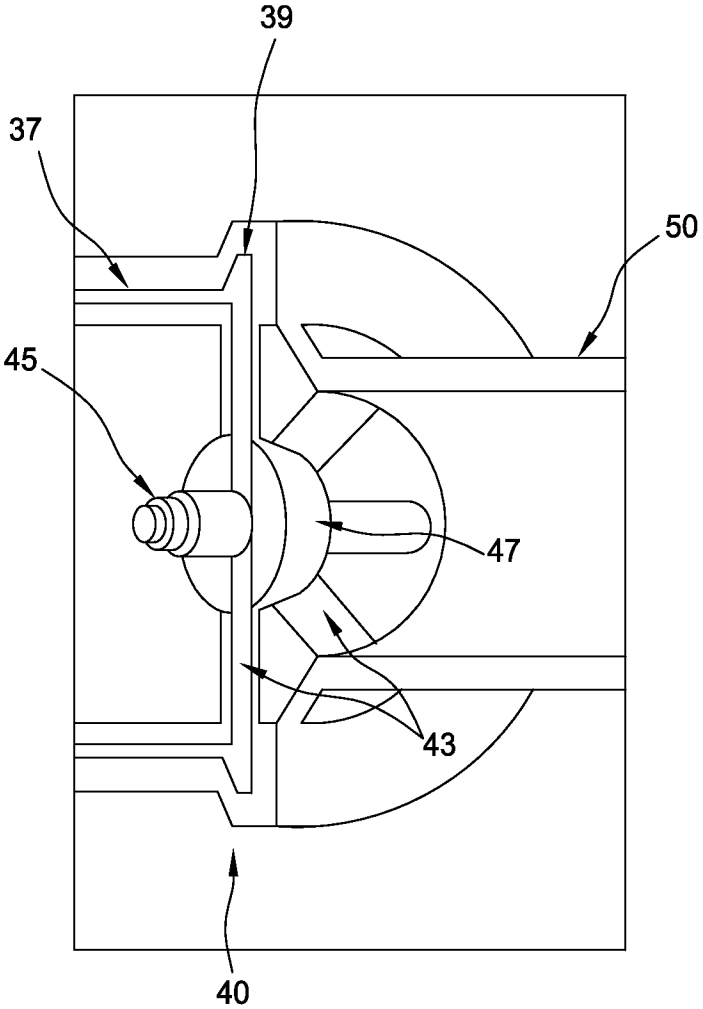
FIG. 6 illustrates a perspective view of an evaporation section according to one embodiment of the invention.

FIG. 6 illustrates a perspective view of the evaporation section 40, and FIG. 7 illustrates a top view of the evaporation section 40. As illustrated, the conduits 43 are coupled to the liner 33 so that the channels 37 are in fluid communication with the conduits 43 via the manifold 39. The conduits 43 may include cylindrical housings having channels disposed through the housings. The conduits 43 may be coupled at the opposite end to the compartment 47. The compartment 47 may include a spherical housing having a cavity disposed within the housing. The cavity of the compartment 47 may be in fluid communication with the channels of the conduits 43, and may be further coupled to the nozzle 45. The nozzle 45 may be adapted to inject fluid droplets, for example, from the fluid communicated to the compartment 47 into the combustion chamber 35. These fluid droplets may be injected into the combustion products generated in the combustion chamber 35, evaporated by the heated combustion products, and exhausted along with the combustion products from the DHSG 10, through the tailpipe 50 for example, and into the oil reservoir. In one embodiment, the heat generated by combustion is used to evaporate the fluid injected as droplets near the end of the combustion chamber 35. The fluid may be preheated as it flows through the liner 33. The droplet injection is configured to cool the components downstream of the combustion chamber 35, evaporate the droplets downstream of the combustion chamber 35 at a distance commensurate with the specific application, avoid adverse impacts on the combustion flame such as quenching, avoid plugging of the nozzle(s) 45, and avoid deposition of solids on the liner walls. In one embodiment, the nozzle 45 may be adapted to generate multiple fluid droplets of multiple sizes in a range of about 10 microns to about 150 microns. In one embodiment, the fluid droplets may impinge on the tailpipe 50 located downstream of the injection section 20. In one embodiment, the fluid droplets may be injected into and/or downstream of the combustion chamber 35, evaporated by the combustion products, and injected into the heavy oil reservoir.

In one embodiment, the conduits may include eight conduits 43 radially disposed around the compartment 47. In one embodiment, liquid water may be heated by heat generated from the combustion flame as it travels through the channels 37 and may exit the channels 37 of the liner 33 into the conduits 43. In one embodiment, liquid water may be injected at a high velocity into the heated combustor exhaust and boiled via droplet evaporation, thereby providing partially or fully saturated steam or superheated steam generation. In one embodiment, liquid water may be evaporated to about a range of 90 percent to 95 percent steam quality at the point of injection into the oil reservoir. In one embodiment, liquid water may be evaporated to about a range of 80 percent to 100 percent steam quality at the point of injection into the oil reservoir. In one embodiment, liquid water may be evaporated to about a range of about 95 percent to about 99 percent steam quality at the point of injection into the heavy oil reservoir.

In one embodiment, the number of droplet injectors, type of droplet injectors, spray pattern, and direction of spray of the evaporation section may be adjusted to provide rapid droplet evaporation and combustion product cooling. The evaporation section facilitates an equilibrium steam quality of the combustion products. In one embodiment, the evaporation section may facilitate fluid droplets impinging on the walls of the combustion section downstream of the injection section so that the wall temperature of the combustion section remains close to the fluid droplet temperature.

In an alternative embodiment, the DHSG 10 may include an injection section that supplies the fuel and the oxidant in such a manner that the fluids mix in the combustion chamber and provides a stable combustion flame having a shape that fits within the combustion chamber volume, during the start-up and shutdown of the DHSG 10, as well as during the full operating range of pressures and stoichiometry. The DHSG 10 may include a number of alternate injection sections that produce diffusion flames, partially premixed diffusion flames, and premixed flames. Each of these flame types may be utilized with the DHSG 10, including stable flames of adequate size during the operation of the DHSG 10.

In one embodiment, the DHSG 10 may include a diffusion flame injection section. The fuel and the oxidant are injected into the combustion chamber as separate fluid streams. The diffusion flame injection section includes injector elements that are operable and arranged to provide controlled mixing of the fluids into the combustion chamber, thereby producing a combustible mixture. The diffusion flame injection section provides a combustion flame that is stabilized by controlling the injection velocities of the fluids into the combustion chamber, such as maintaining low injection velocities of the fluids relative to the flame speed, and/or by recirculating hot combustion products back to the base of the flame, such as by injecting the fuel and/or the oxidant with a swirl that produces an axisymmetric recirculation zone or by generating a recirculation zone in the wake behind a bluff body or the walls of the injectors themselves. The combustion flame shape may be adjusted by controlling the rate of the fuel/oxidant mixing. In general, rapid mixing produces a compact high intensity combustion flame with high radiative heat transfer in contrast to slow mixing which produces a larger low intensity combustion flame with lower radiative heat transfer. By varying the swirl and the injection velocities, the combustion flame shape can be adjusted to fit the combustion chamber. In one embodiment, the DHSG 10 may include one or more injection sections/elements to provide additional combustion flame shaping flexibility, such as by operating less than all of the injection sections/elements during lower operating ranges or by reducing the range of firing rates for each individual injection section/elements to provide enhanced combustion flame stability and control.

A method of utilizing the DHSG 10 may include supplying natural gas and an oxygen and carbon dioxide mixture to an injector body of the DHSG 10. The mixture may be mixed at the surface and supplied to the DHSG 10 in a single conduit and the fluids may be mixed in the injector body. The DHSG 10 may be positioned in a first well for use as an injection well. The method may further include directing the fluids through one or more injector elements that are in fluid communication with the combustion chamber. The injector elements may be coupled to the injector body and disposed in a circular array. The injector elements may include a body and a sleeve surrounding the body. The method may further include directing the mixture from a first plenum of the injector body, through a channel of the body of an injector element, and injecting the mixture into the combustion chamber. The method may further include directing the natural gas from a second plenum of the injector body, and optionally directing a diluting or cooling fluid, such as water, partially or fully saturated steam, oxygen, air, enriched air, nitrogen, hydrogen, and/or carbon dioxide, from an optional third plenum of the injector body, through the sleeve of the injector element, such that the fluids form a swirling pattern as they are directed through the sleeve. The method may further include injecting the fluids into the combustion chamber with the mixture. The method may further include providing an ignition flame from an igniter through an igniter port disposed through the injector body to combust the mixture of fluids injected into the combustion chamber. The method may further include igniting the mixture of fluids in the combustion chamber, thereby generating a combustion flame and combustion products. The swirling pattern may help maintain a stabilized combustion flame within the combustion chamber. The fluids flowing through the combustion section may provide cooling of the DHSG 10, and the temperature of the DHSG 10 may be controlled by carbon dioxide dilution. In one embodiment, additional cooling passages may be provided in the combustion section. The method may further include supplying a fluid, such as water, through one or more channels of a liner, wherein the liner surrounds the combustion chamber. The method may further include heating the fluid as it travels through the channels by the combustion reactions in the combustion chamber, wherein the fluid cools the liner. The combustion flame may transfer heat to the liner walls by radiative and convective heat transfer. The method may further include injecting the heated fluid from the channels into the combustion chamber, in a droplet form, via one or more conduits in fluid communication with the channels, and boiling the heated fluid via droplet evaporation, wherein the combustion flame and products evaporate fluid droplets of the heated fluid injected into the combustion chamber. The fluid may cool the combustion products. The method may further include injecting the combustion products and the evaporated fluid droplets into an oil reservoir to upgrade and/or reduce the viscosity of hydrocarbons in the oil reservoir. The method may further include recovering at least the upgraded and/or less viscous hydrocarbons from a second well that is located adjacent to the first well in which the DHSG is located. The second well may be utilized as a production well. The production well may include one or more pressure control devices located at the surface to control the back pressure on the oil reservoir. In one embodiment, a choke valve may be used to maintain and/or control the pressure and/or flow of fluids recovered from the oil reservoir via the production well.

The DHSG 10 may be operable under pressure conditions in a range of about 800 psi to about 1,600 psi. The DHSG 10 may be operable under pressure conditions in a range of about 500 psi to about 2,000 psi. In one embodiment, the DHSG 10 is operable under a pressure range of about 800 psi to about 2,000 psi. In one embodiment, the DHSG 10 may be operable under pressure conditions in a range of about 100 psi to about 4,000 psi. In one embodiment, the DHSG 10 may be operable under pressure conditions up to about 10,000 psi. In one embodiment, the DHSG 10 may also be operable under a nominal flame temperature in a range of about 3,200 degrees Fahrenheit to about 3,450 degrees Fahrenheit. In one embodiment, the DHSG 10 may also be operable under a nominal flame temperature in a range of about 2,500 degrees Fahrenheit to about 5,500 degrees Fahrenheit. In one embodiment, the DHSG 10 is operable under a nominal flame temperature in a range of about 3,000 degrees Fahrenheit to about 3,500 degrees Fahrenheit. In one embodiment, the DHSG 10 may be operable at internal pressures up to 1,800 psi and exhaust a heated fluid mixture at up to 600 degrees Fahrenheit. In one embodiment, the DHSG 10 may be operable to exhaust a heated fluid mixture at a temperature within a range of about 500 degrees Fahrenheit to about 800 degrees Fahrenheit. In one embodiment, the DHSG 10 may be operable to exhaust a heated fluid mixture at a temperature within a range of about 250 degrees Fahrenheit to about 800 degrees Fahrenheit. In one embodiment, the DHSG 10 may be operable to exhaust a heated fluid mixture at a temperature of about 600 degrees Fahrenheit. In one embodiment, the DHSG 10 may be operable to limit metal temperatures to below 1,000 degrees Fahrenheit.

The DHSG 10 may be configured to generate a fluid having a steam quality in a range of about 75 percent to about 100 percent. In one embodiment, the DHSG 10 may be configured to generate a fluid having about a 90 percent to about a 95 percent steam quality. The DHSG 10 may also be configured to provide a mass flow rate of a fluid, such as partially saturated, fully saturated, or superheated steam, in a range of about 400 barrels per day (bbd) to about 1500 barrels per day. In one embodiment, the DHSG 10 may be configured to provide a mass flow rate of a fluid, such as partially saturated, fully saturated, or superheated steam, at about 1500 bbd under a pressure condition of about 1600 psi. Finally, the DHSG 10 may be configured to have a minimum operating life of about 3 years.

The DHSG 10 may be configured to inject a mixture of fluids into a formation to heat the formation and to facilitate the recovery of hydrocarbons from the formation, such as by reducing the viscosity of heavy oil located in the formation. In one embodiment, the mixture may comprise from about 18 percent to about 29 percent of carbon dioxide by volume. In one embodiment, the mixture may comprise from about 10 percent to about 30 percent of carbon dioxide by volume. In one embodiment, the mixture may comprise from about 1 percent to about 40 percent of carbon dioxide by volume. In one embodiment, the mixture may comprise about 0.5 percent or about 5 percent of oxygen by volume. In one embodiment, the mixture may comprise from about 0.5 percent to about 5 percent of oxygen by volume. The mixture may be injected into the formation at a pressure of about 900 psi, 1200 psi, or 1600 psi. The mixture may be injected into the formation at a mass flow rate of about 400 bbd, 800 bbd, 1200 bbd, or 1500 bbd.

Figure 8:
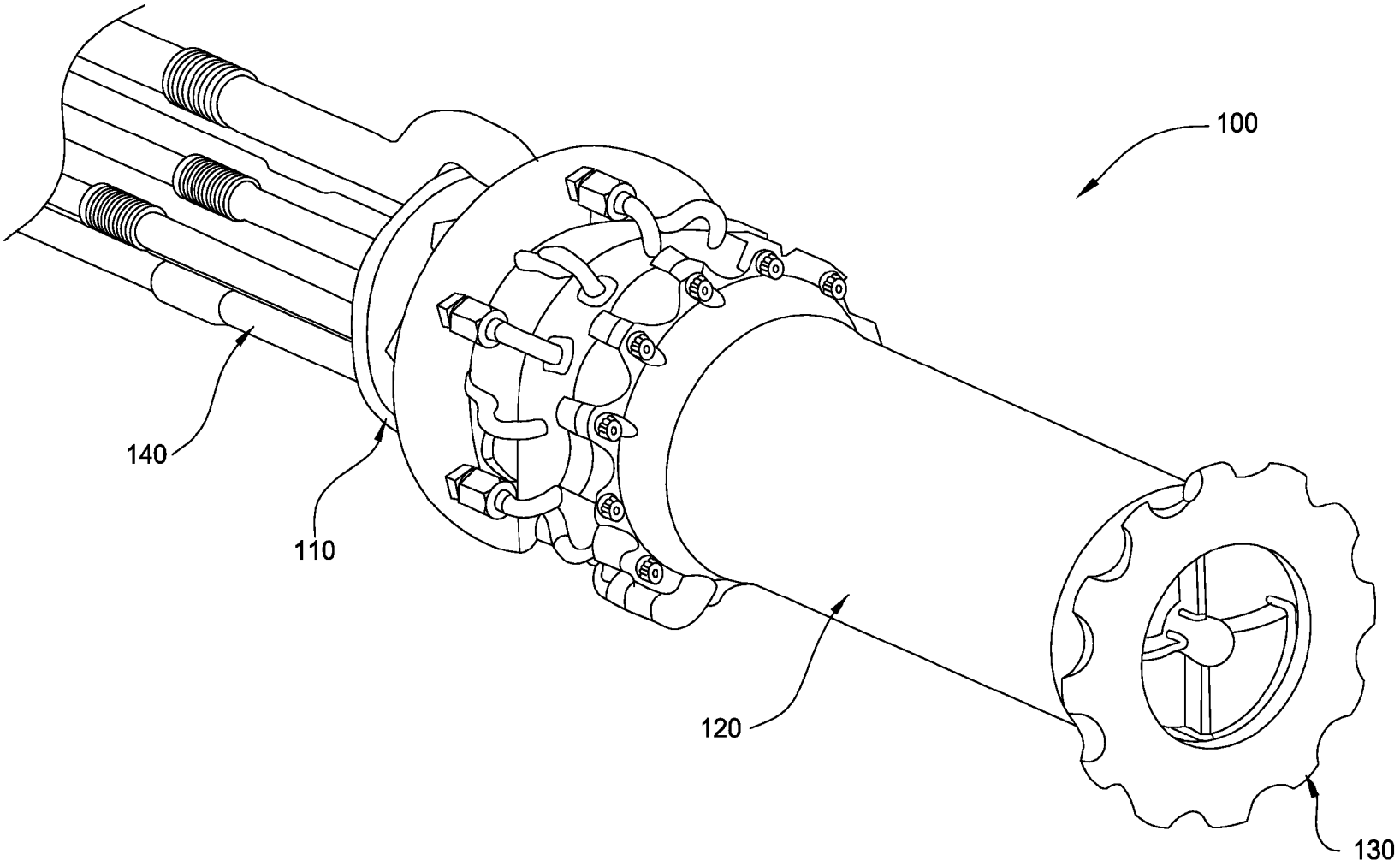
FIG. 8 illustrates an isometric view of a downhole steam generator according to one embodiment of the invention.

FIG. 8 illustrates an isometric view of a DHSG 100 according to one embodiment of the invention. The DHSG 100 includes an injection section 110, a combustion section 120, and an evaporation section 130. The injection section 110, the combustion section 120, and the evaporation section 130 may operate similarly to the injection section 20, the combustion section 30, and the evaporation section 40 of the DHSG 10 described above, with some additional modifications as will be described below. The same embodiments described above with respect to the DHSG 10 may be used with the DHSG 100 described herein, and vice versa. In addition, the DHSG 100 may also be configured to operate under the same operating conditions recited above with respect to the DHSG 10. As illustrated, the injection section 110 is in fluid communication with feed tubes 140 for supplying one or more fluids to the injection section 110, some of which are supplied to injection manifolds (further described below) of the injection section 110 for combustion and injection into a hydrocarbon-bearing formation, such as a heavy oil reservoir. The combustion section 120 may be coupled at its upper end to the injection section 110 by a bolted connection. The combustion section 120 may include a plurality of pressure relief ports to facilitate operation of the DHSG 100. The evaporation section 130 may be disposed within the lower end of the combustion section 120 for injection of a cooling fluid, such as $H_2O$, into the combustion section 120.

Figure 9:
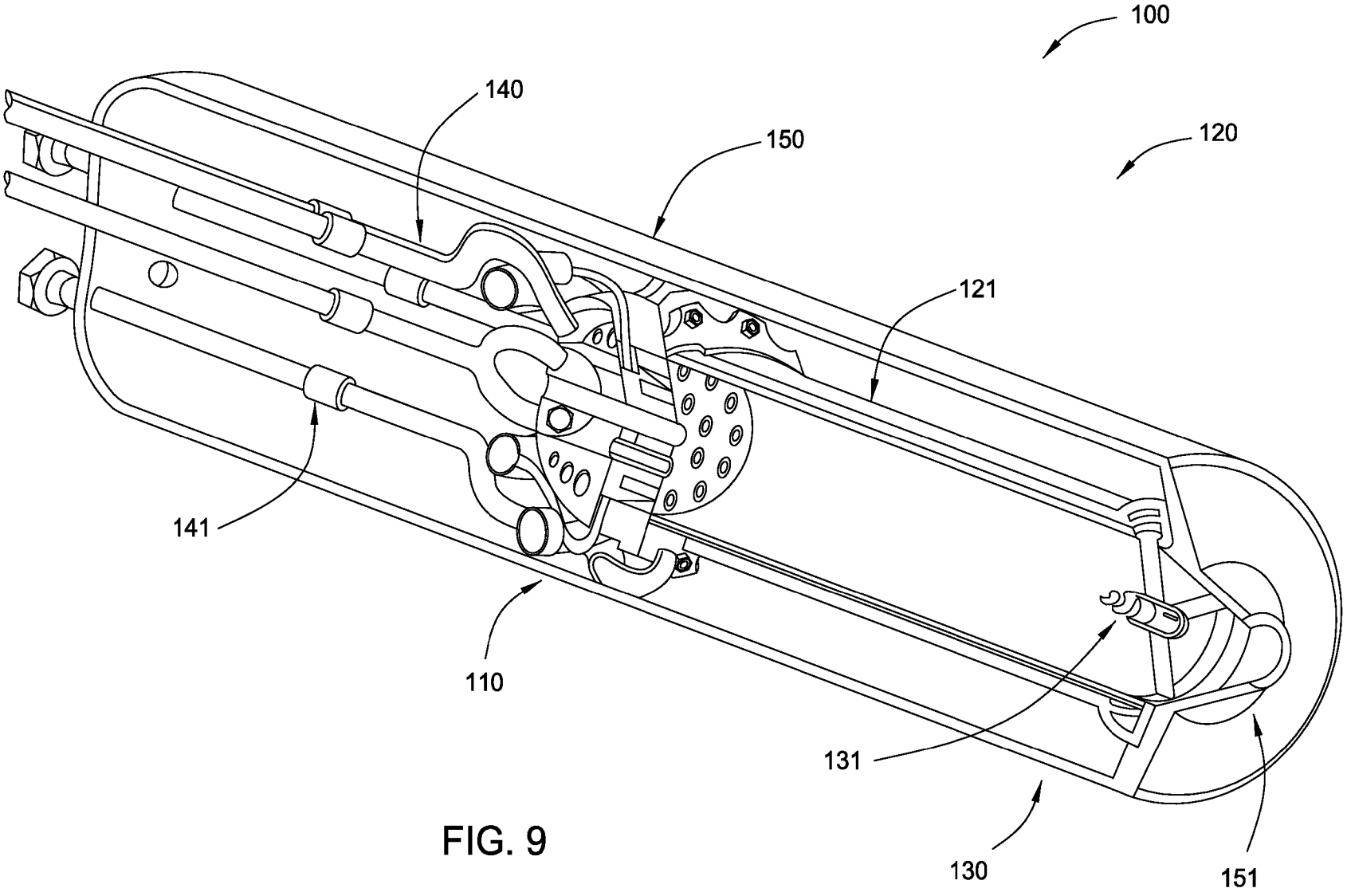
FIG. 9 illustrates a cross sectional view of the downhole steam generator according to one embodiment of the invention.

FIG. 9 illustrates a cross section view of the DHSG 100. The DHSG 100 is enclosed by a housing 150, such as a casing. The housing 150 may include a metallic cylindrical body having a hollow internal chamber for supporting the injection section 110, the combustion section 120, the evaporation section 130, and the feed tubes 140. The feed tubes 140 may be configured for supplying fluids to the injection section 110 and may include one or more bellows 141 to compensate for expansion, contraction, and/or movement of the feed tubes 140 due to thermal, pressure, or mechanical stresses experienced by the feed tubes 140. In one embodiment, four or five feed tubes 140 are included in the DHSG 100. One or more of the fluids supplied to the injection section 110 may then be mixed and injected into a combustion chamber 121 of the combustion section 120 for combustion. A fluid may also be injected into the combustion chamber 121 and/or downstream of the combustion chamber 121 by an injector 131 of the evaporation section 130 and combined with the combustion products. The injector 131 may be operable to inject liquid water droplets, for example, into the combustion chamber 121 and/or downstream of the combustion chamber 121, which are evaporated when combined with the combustion products, thereby forming partially saturated, fully saturated, or superheated steam. The bottom end of the housing 150 may have a nozzle 151 for exhausting the combustion products and the steam out of the DHSG 100 and injecting them into a hydrocarbon-bearing formation.

Figure 10:
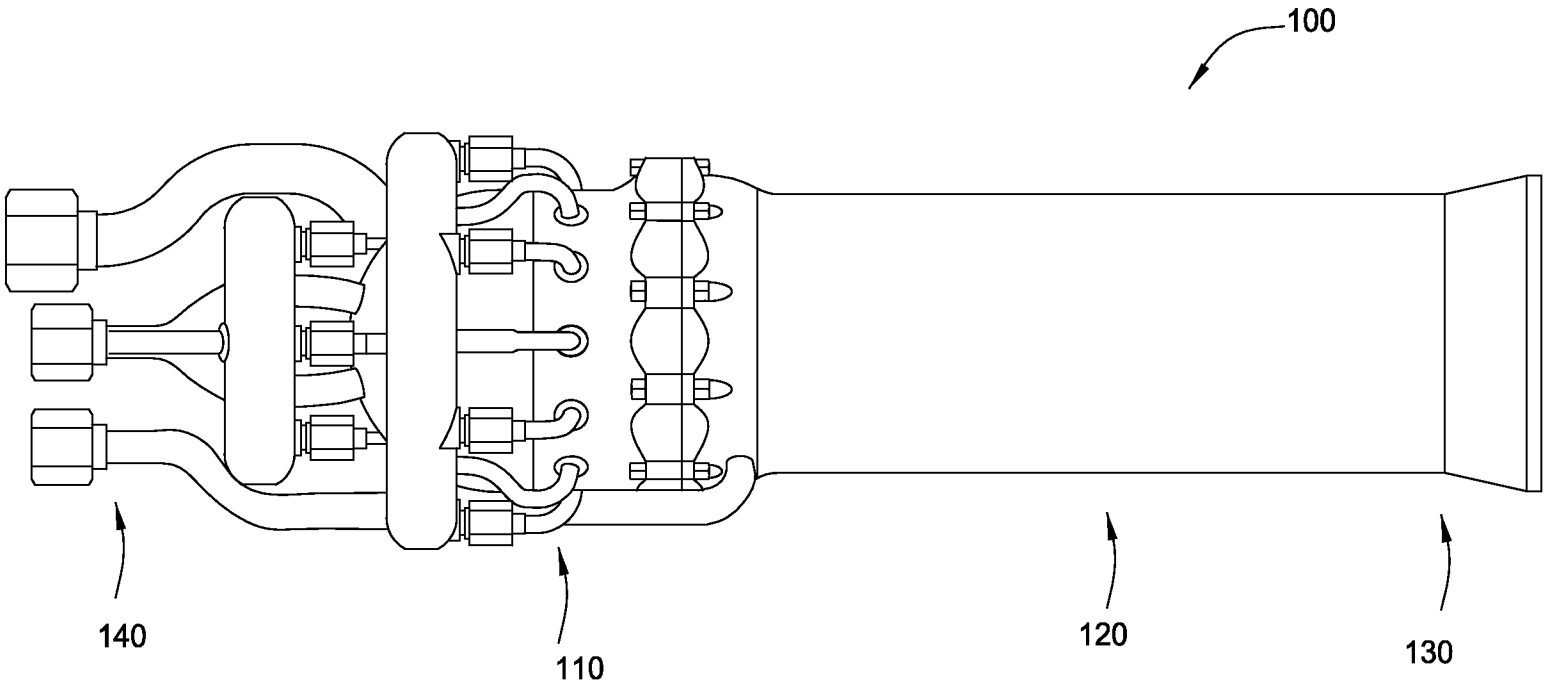
FIGS. 10 and 11 illustrate a side view and a cross sectional view of the downhole steam generator according to one embodiment of the invention.
Figure 11:
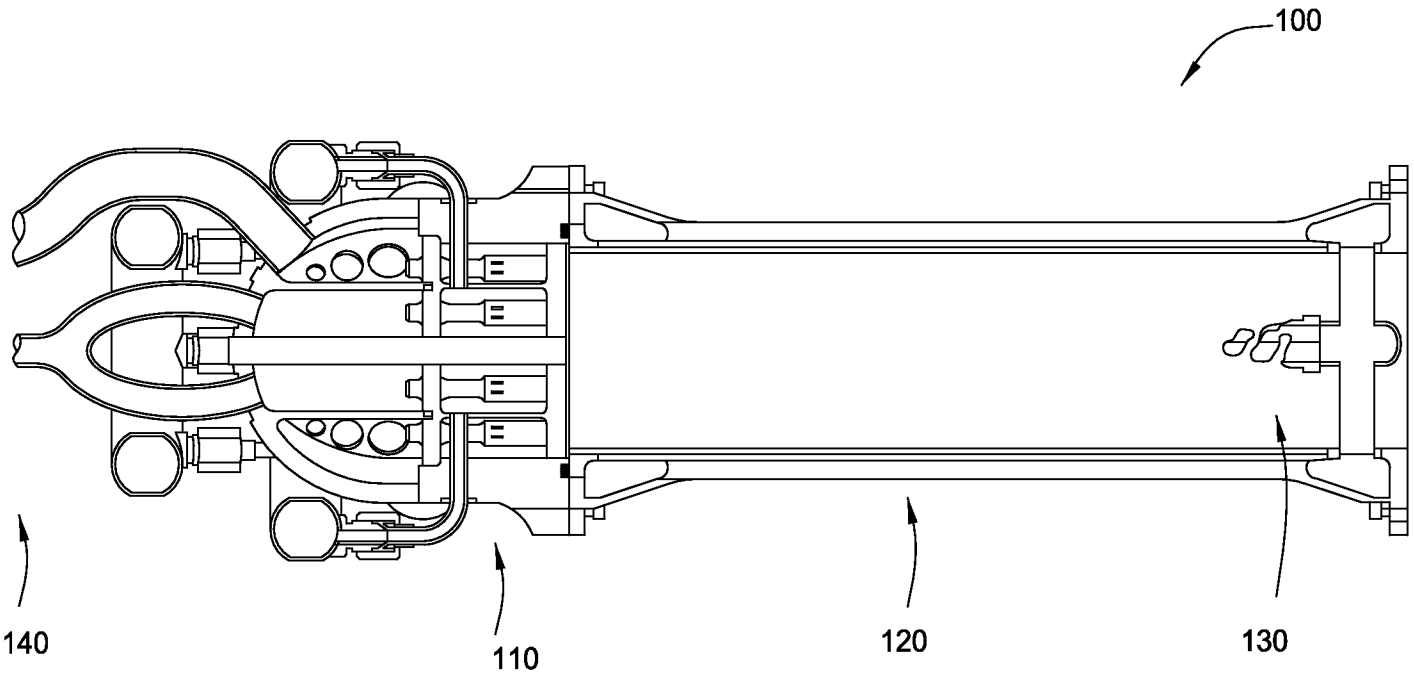

FIGS. 10 and 11 illustrate a side view and a cross section view of the DHSG 100. As shown, the DHSG 100 may include an overall length of less than about 30 feet, may operate within wellbore conditions having a pressure range of about 800 psi to about 1600 psi, may be operable to receive combustion fluids at a maximum pressure of about 3000 psi and at a temperature range of about 75 degrees Fahrenheit to about 180 degrees Fahrenheit. In one embodiment, the DHSG 100 may be operable to receive combustion fluids at a temperature range of about 32 degrees Fahrenheit to about 210 degrees Fahrenheit. The combustion section 120 may include an internal diameter of about 3 inches and the DHSG 100 may include a maximum outer diameter of about 6 inches. The DHSG 100 may be operable to inject combustion fluids at a pressure of about 1800 psi and a temperature of about 600 degrees Fahrenheit into a hydrocarbon-bearing formation. In one embodiment, the DHSG 100 may include a turndown ratio of about 4:1 with a flow rate of about 1,500 bbd. In one embodiment, the DHSG 100 may include a pressure turndown ratio of about 2:1 within a wellbore pressure environment of about 1600 psi. In one embodiment, the DHSG 100 may be configured to include a mass flow rate turndown ratio of about 4:1. In one embodiment, the DHSG 100 may be configured to include an internal fluid velocity flow rate turndown ratio of about 8:1.

Figure 12:
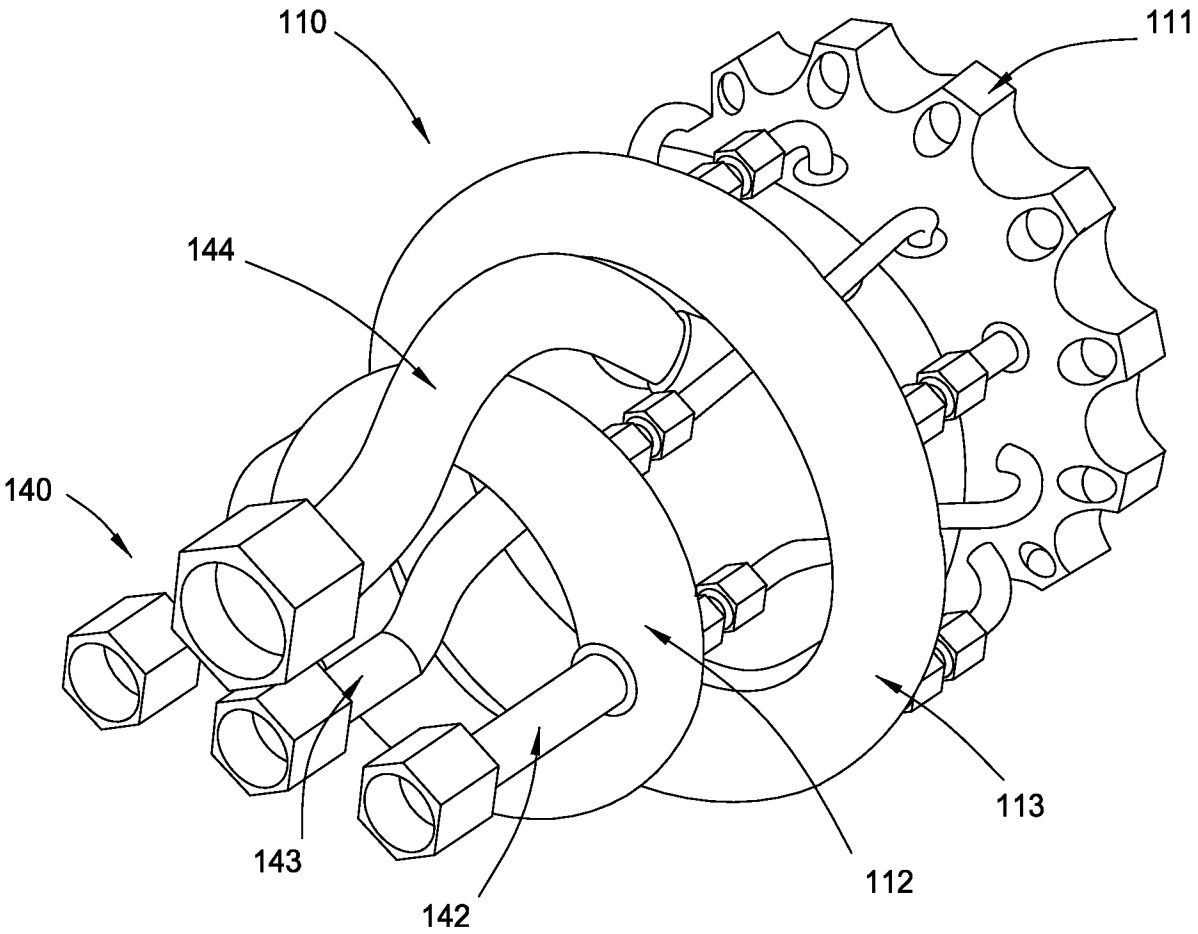
FIG. 12 illustrates an upper end isometric view of an injection section according to one embodiment of the invention.

FIG. 12 illustrates an upper end isometric view of the injection section 110 coupled to the feed tubes 140. The injection section 110 includes a housing having a flanged end 111 for connection to the combustion section 120. The injection section 110 also includes an upper manifold 112 and a lower manifold 113 circumscribing the housing of the injection section 110 for supplying a fluid, such as a fuel, such as methane, to the injection section 110. The manifolds 112 and 113 may comprise cylindrical conduits surrounding the housing of the injection section 110 and having a circular, such as a ring or halo-type, shape. A first feed tube 142 is coupled to the upper manifold 112 for supplying a fluid from the surface of a wellbore to the DHSG 100. In one embodiment, the feed tube 142 may also be coupled to the lower manifold 113. In one embodiment, a separate feed tube may be coupled to the lower manifold 113 for supplying a fluid to the injection section 110, such that the fluid may be the same or a different fluid supplied to the upper manifold. Also illustrated are feed tubes 143 and 144 coupled to the injection section 110 (further described below).

Figure 13:
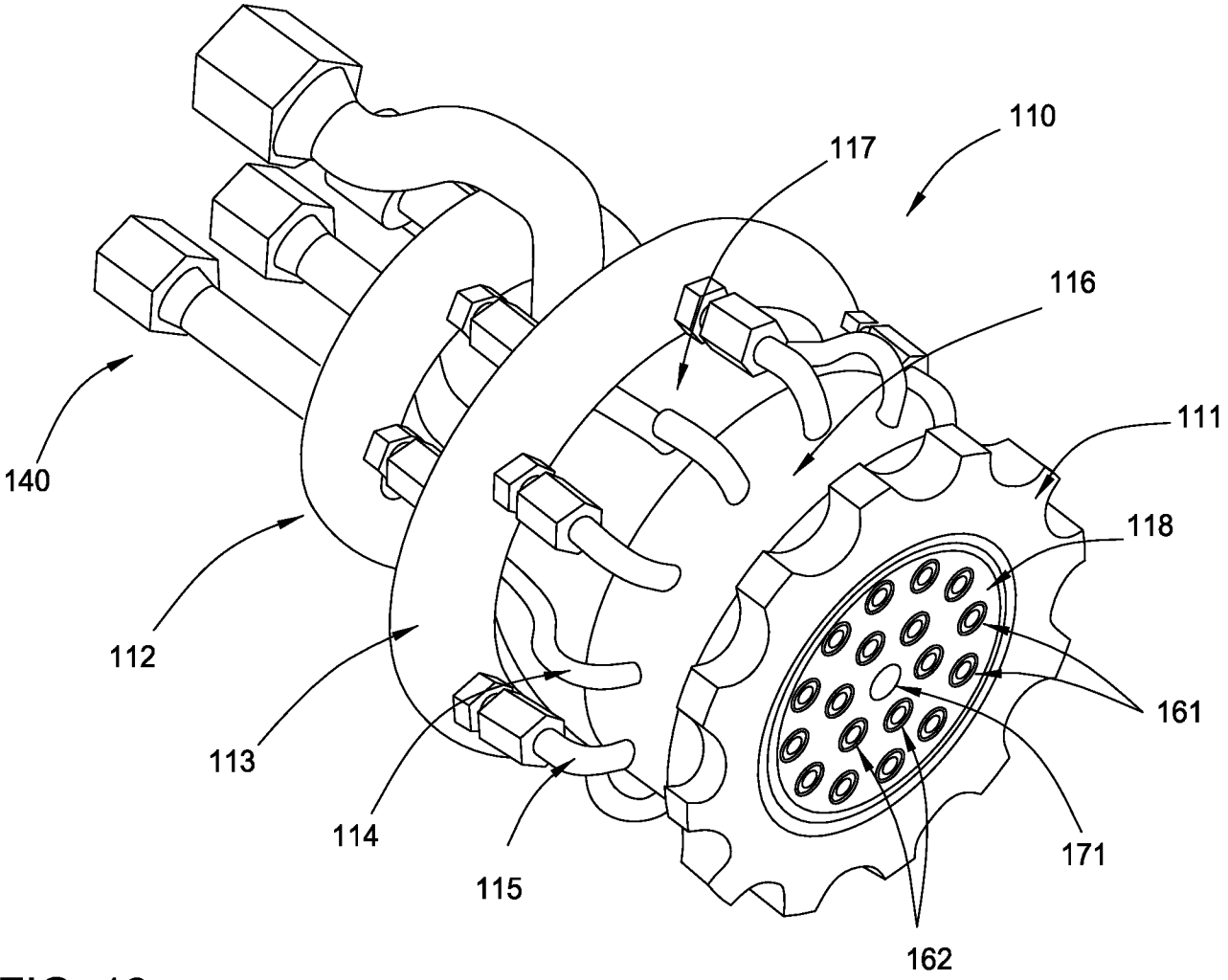
FIG. 13 illustrates a lower end isometric view of the injection section according to one embodiment of the invention.

FIG. 13 illustrates a lower end isometric view of the injection section 110. The housing of the injection section 110 includes an upper section 117 and a lower section 116, each comprising cylindrical bodies having flow bores therethrough. The upper section 117 may include a dome or hemispherical shaped top end. The manifolds 112 and 113 each include one or more supply tubes 114 and 115, respectively, that extend from the manifolds to the lower section 116 of the housing, The supply tubes 114 and 115 may be coupled to the bottoms of the manifolds and the side of the housing, thereby establishing fluid communication therebetween. The supply tubes 114 and 115 may be equally spaced around the circumference of the manifolds and/or the housing of the injection section 110.

Also illustrated is an injector plate 118 coupled to and sealingly engaged with the flanged end 111 of the housing for directing the combustion fluids into the combustion section 120 of the DHSG 100. The injector plate 118 may also be operable for supporting one or more injector elements and an igniter (further described below). The injector plate 118 may include first injector element ports 161, second injector element ports 162, and an igniter port 171. The first injector element ports 161 may be equally spaced apart forming a circular pattern adjacent the outer diameter of the injector plate 118. The second injector element ports 162 may also be equally spaced apart forming a circular pattern adjacent the center of the injector plate 118, surrounded by the first injector element ports 161. The igniter port 171 may be disposed in the center of the injector plate 118 and surrounded by the first and second injector element ports 161 and 162.

Figure 14:
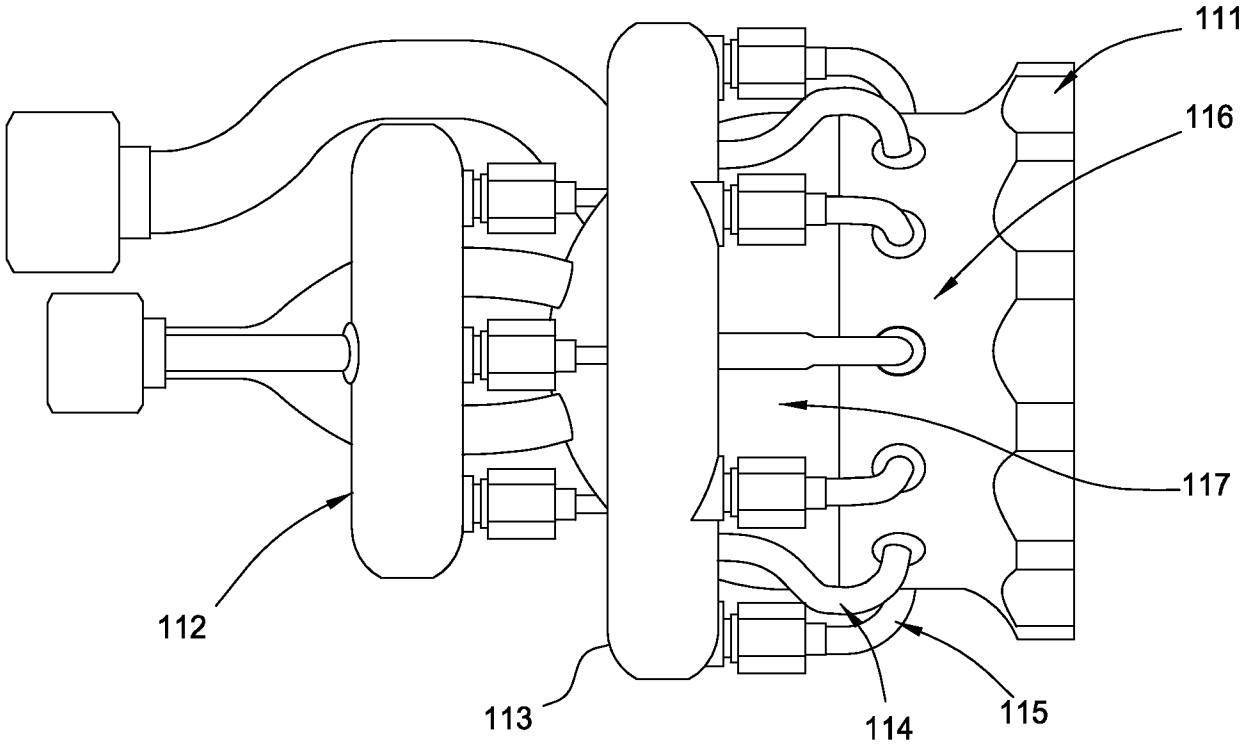
FIG. 14 illustrates a side view of the injection section according to one embodiment of the invention.

FIG. 14 illustrates a side view of the injection section 110. The supply tubes 114 and 115 may be coupled to the manifolds 112 and 113 by a fitting, such as a JIC fitting, and may be coupled to the lower section 116 of the housing by a weld, such as a braze or electronic beam weld. A non-conductive coating may be applied to the bottom of the flanged end 111 to mitigate corrosion of the housing and the connection to the combustion section 120.

Figure 15:
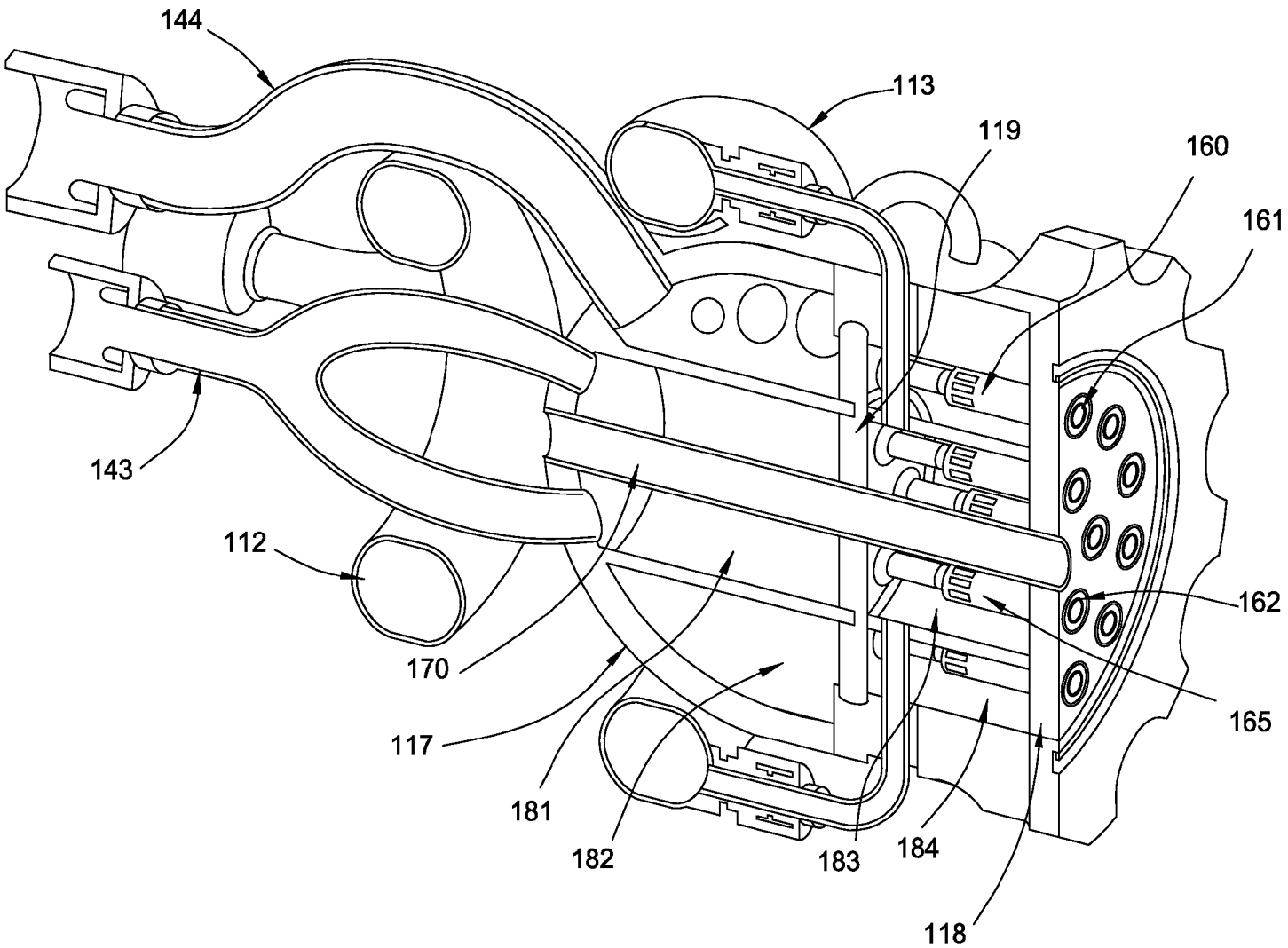
FIGS. 15, 16, and 17 illustrate cross sectional views of the injection section according to one embodiment of the invention.

FIG. 15 illustrates a cross section view of the injection section 110. The injection section 110 further includes an igniter housing 170 for supporting an igniter as described above. The upper section 117 may be coupled to the lower section 116 by a welded or bolted connection. A housing plate 119 may be sealingly disposed between the upper and lower sections 117 and 116. In one embodiment, the housing plate 119 may be disposed upon an inner edge of the lower section 116. The upper section 117 of the housing further includes an inner chamber 181 through which the igniter housing 170 is disposed and an outer chamber 182 surrounding and sealingly isolated from the inner chamber 181. The outer chamber 182 may include one or more conduits forming circular flow paths disposed around the inner chamber 181. The lower section 116 of the housing similarly includes an inner chamber 183 through which the igniter housing 170 is disposed and an outer chamber 184 surrounding and sealingly isolated from the inner chamber 183. The outer chamber 184 supports injector elements 160 and the inner chamber 183 supports injector elements 165, the upper ends of which extend into the outer and inner chambers 182 and 181, respectively of the upper section 117. The injector elements 160 and 165 may operate in a similar manner as the injector elements 27 described above with respect to the DHSG 10.

Figure 16:
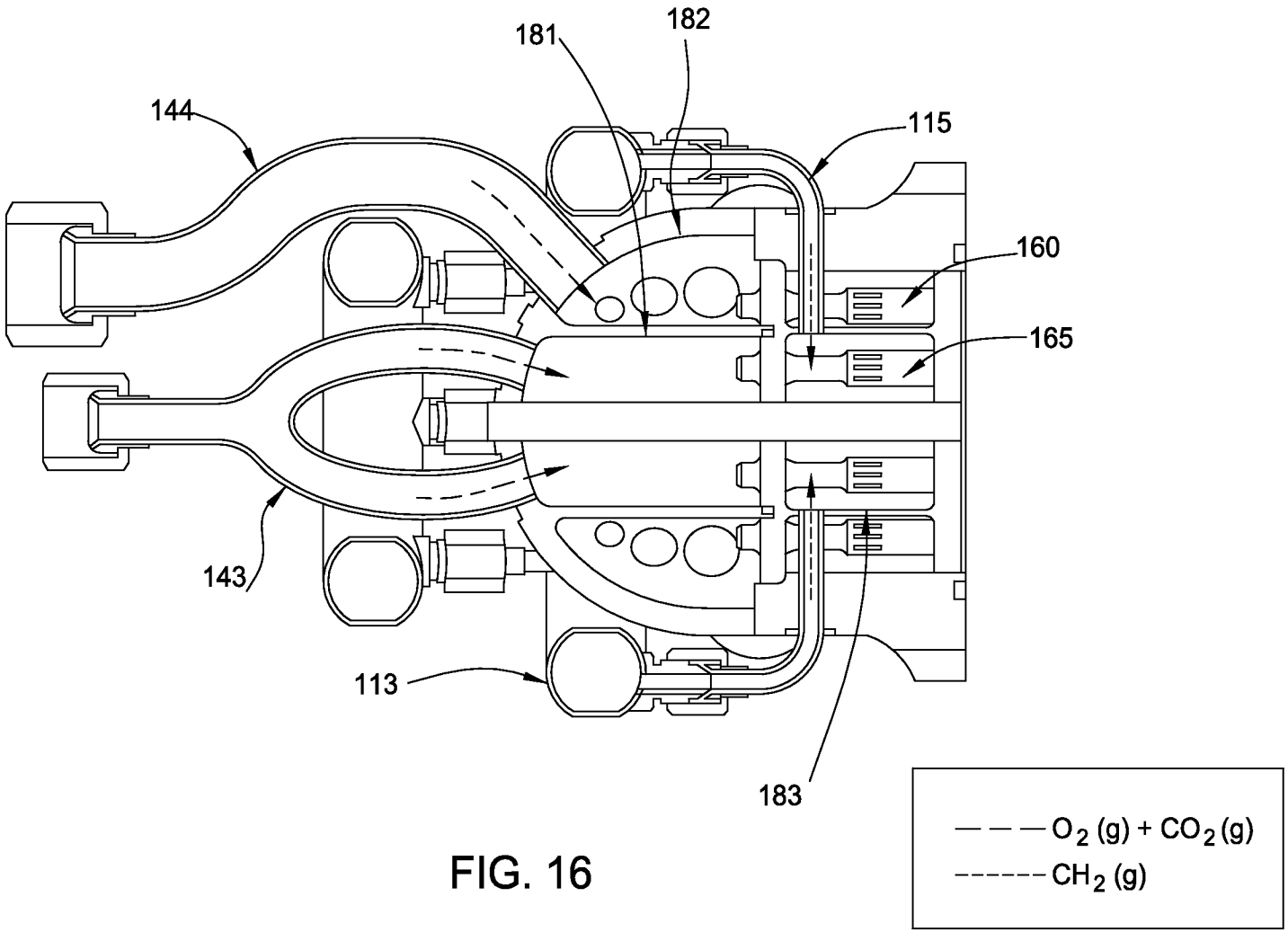

Illustrated in FIGS. 15 and 16 is the second feed tube 143 in fluid communication with the inner chamber 181 of the upper section 117. The second feed tube 143 may comprise one or more flow paths for supplying a fluid, such as an oxidant, for example an oxygen and carbon dioxide mixture or an oxygen and carbon dioxide mixture having a small percentage of nitrogen, at an increased amount to the inner chamber 181. The fluid is directed from the inner chamber 181 to the injector elements 165. The fluid may then be mixed within the injector elements 165 with another fluid, such as a fuel, that is supplied to the injector elements 165 via the lower manifold 113. The supply tubes 115 extend from the lower manifold 113 to the inner chamber 183 of the lower section 116 and into the injector elements 165. The combined fluids are then injected into the combustion section 120 and ignited by the igniter.

Figure 17:
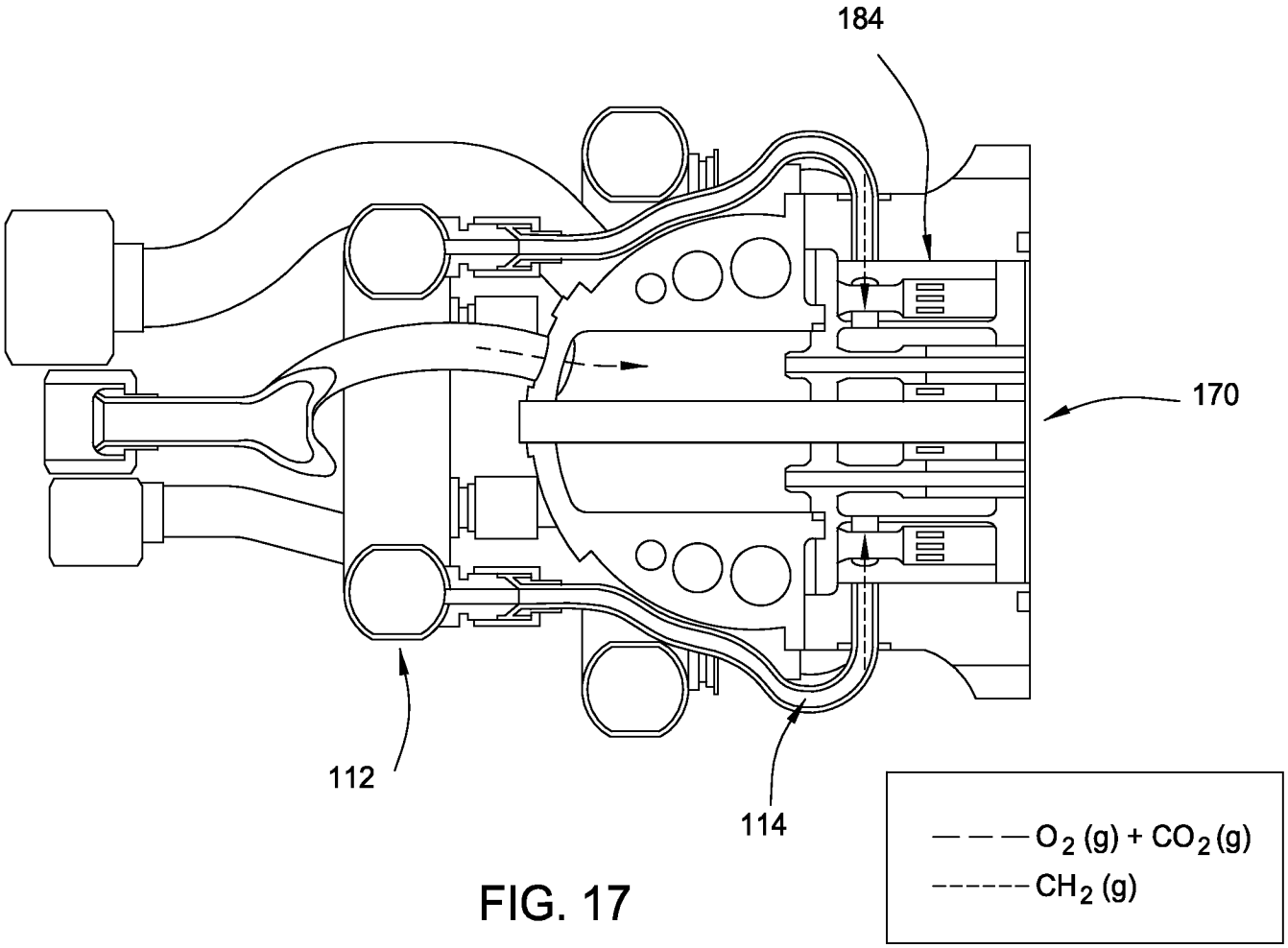

Illustrated in FIGS. 15 and 17 is the third feed tube 144 in fluid communication with the outer chamber 182 of the upper section 117 of the housing. The third feed tube 144 may comprise one or more flow paths for supplying a fluid, such as an oxidant, for example an oxygen and carbon dioxide mixture or an oxygen and carbon dioxide mixture having a small percentage of nitrogen, at an increased amount to the outer chamber 182. The fluid is directed from the outer chamber 182 to the injector elements 160. The fluid may then be mixed within the injector elements 160 with another fluid, such as a fuel, that is supplied to the injector elements 160 via the upper manifold 112. The supply tubes 114 extend from the upper manifold 112 to the outer chamber 184 of the lower section 116 and into the injector elements 160. The combined combustion product is then injected into the combustion section 120 and ignited by the igniter.

In one embodiment, the feed tubes 140 and/or the igniter housing 170 may be formed from a metallic material, such as a nickel-copper alloy, such as Monel. In one embodiment, the manifolds 112 and 113 may be formed from a metallic material, such as a nickel-cobalt alloy, such as Haynes 188. In one embodiment, the upper section 117 of the housing may be formed from a metallic material, such as a nickel-copper alloy, such as Monel. In one embodiment, the lower section 116 of the housing may be formed from a metallic material, such as a nickel-cobalt alloy, such as Haynes 188. In one embodiment, the injector elements 160 and 165 may be formed from a metallic material, such as a nickel-copper alloy, such as Monel.

Figure 18:
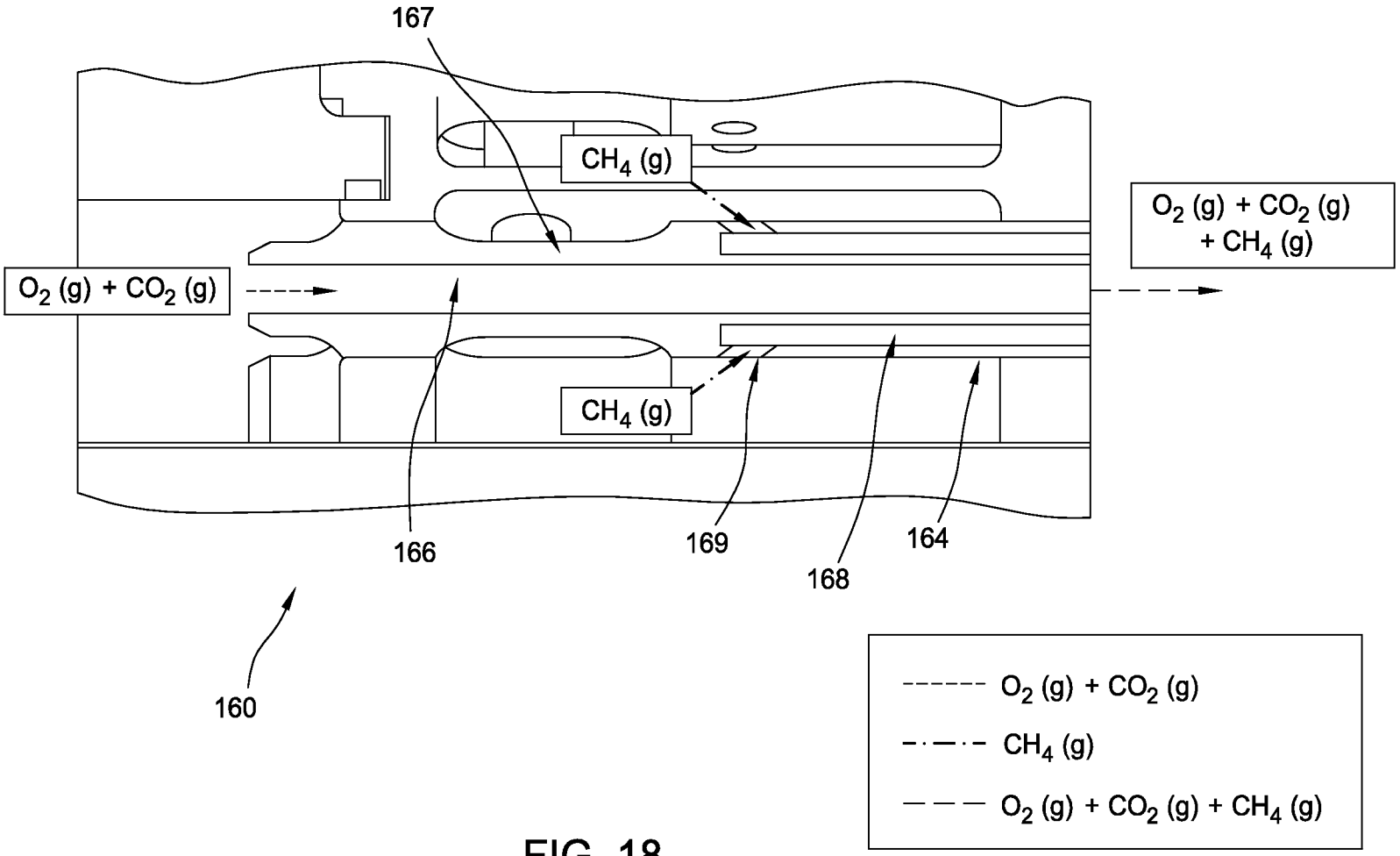
FIG. 18 illustrates a cross sectional view of an injector element according to one embodiment of the invention.

FIG. 18 illustrates a cross sectional view of an injector element 160. Injector element 160 may be the same as injector element 165 disclosed above. The injector element 160 has an upper end in fluid communication with a chamber of the upper section 117 via an inner flow bore 166 disposed through the body 167 of the injector element. The inner flow bore 166 directs a fluid into the combustion section 120. The injector element has a middle or lower section in fluid communication with a chamber of the lower section 116 via an outer flow bore 168 disposed through a sleeve 164 surrounding the body 167 and the inner flow bore 166 of the injector element. The outer flow bore 168 directs a fluid into the combustion section 120. The sleeve 164 may include one or more ports 169 that are angled relative to the outer flow bore 168 to introduce a swirling effect of the fluid flowing therethrough. The swirling effect facilitates mixing of the fluid with the other fluids that are injected into the combustion chamber 120.

Figure 19:
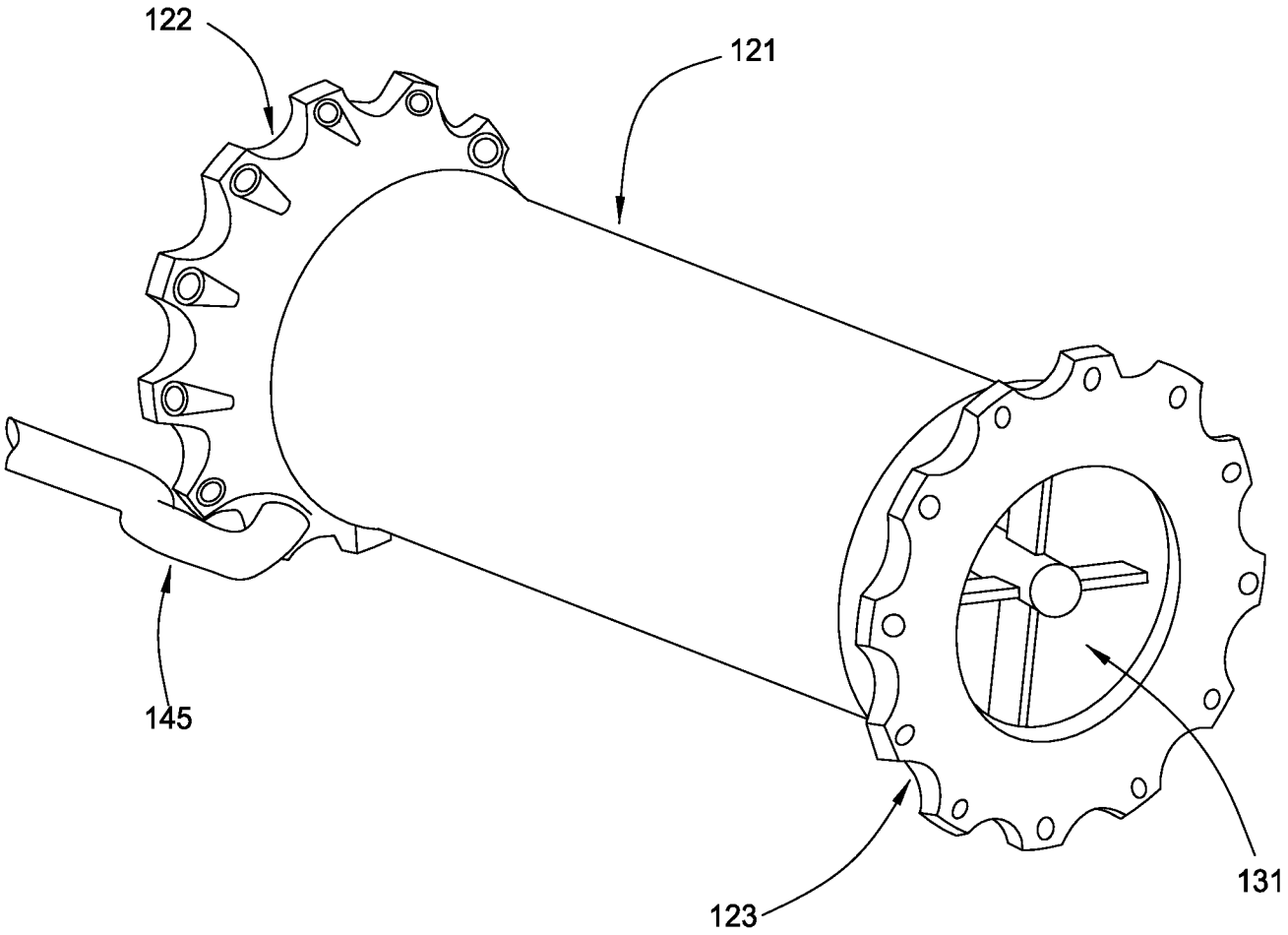
FIGS. 19, 20, and 21 illustrate isometric and cross sectional views of a combustion section and an evaporation section according to one embodiment of the invention.
Figure 20:
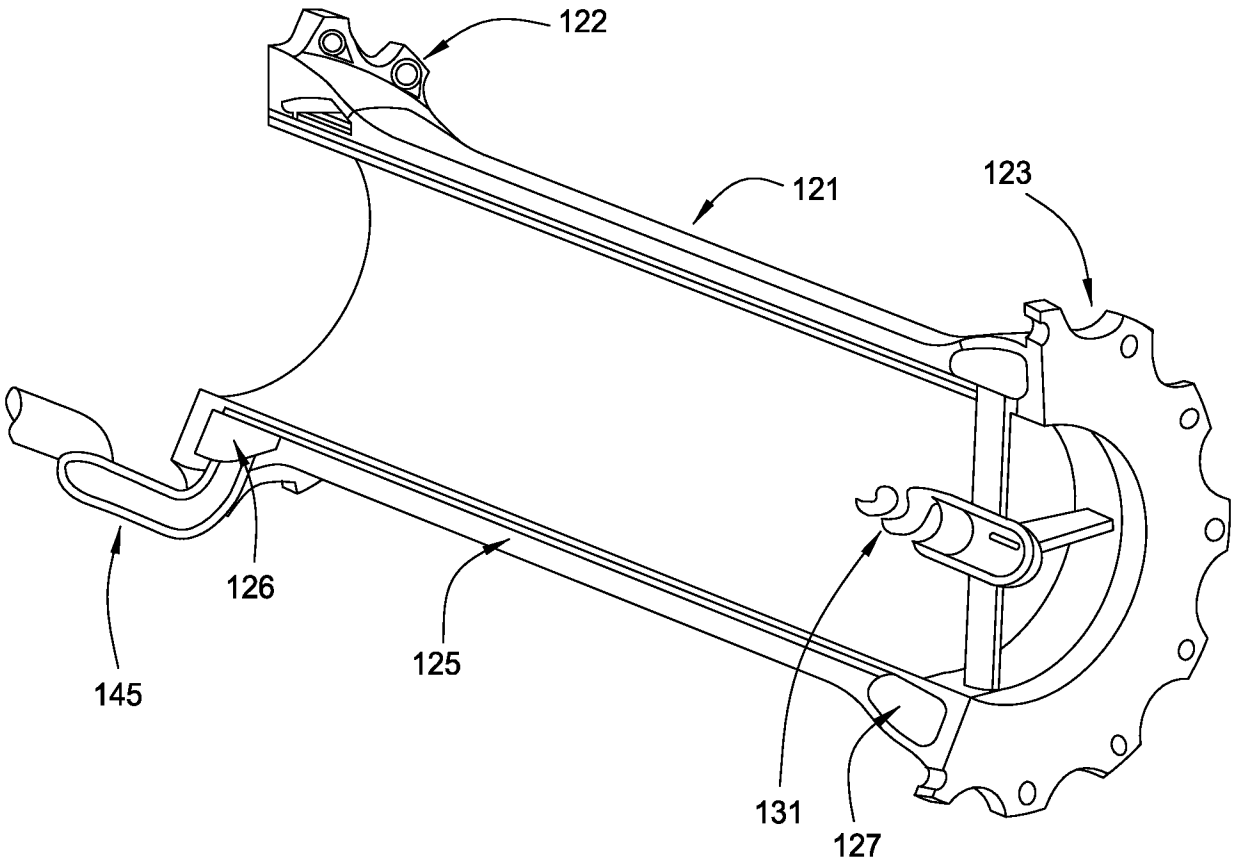
Figure 21:
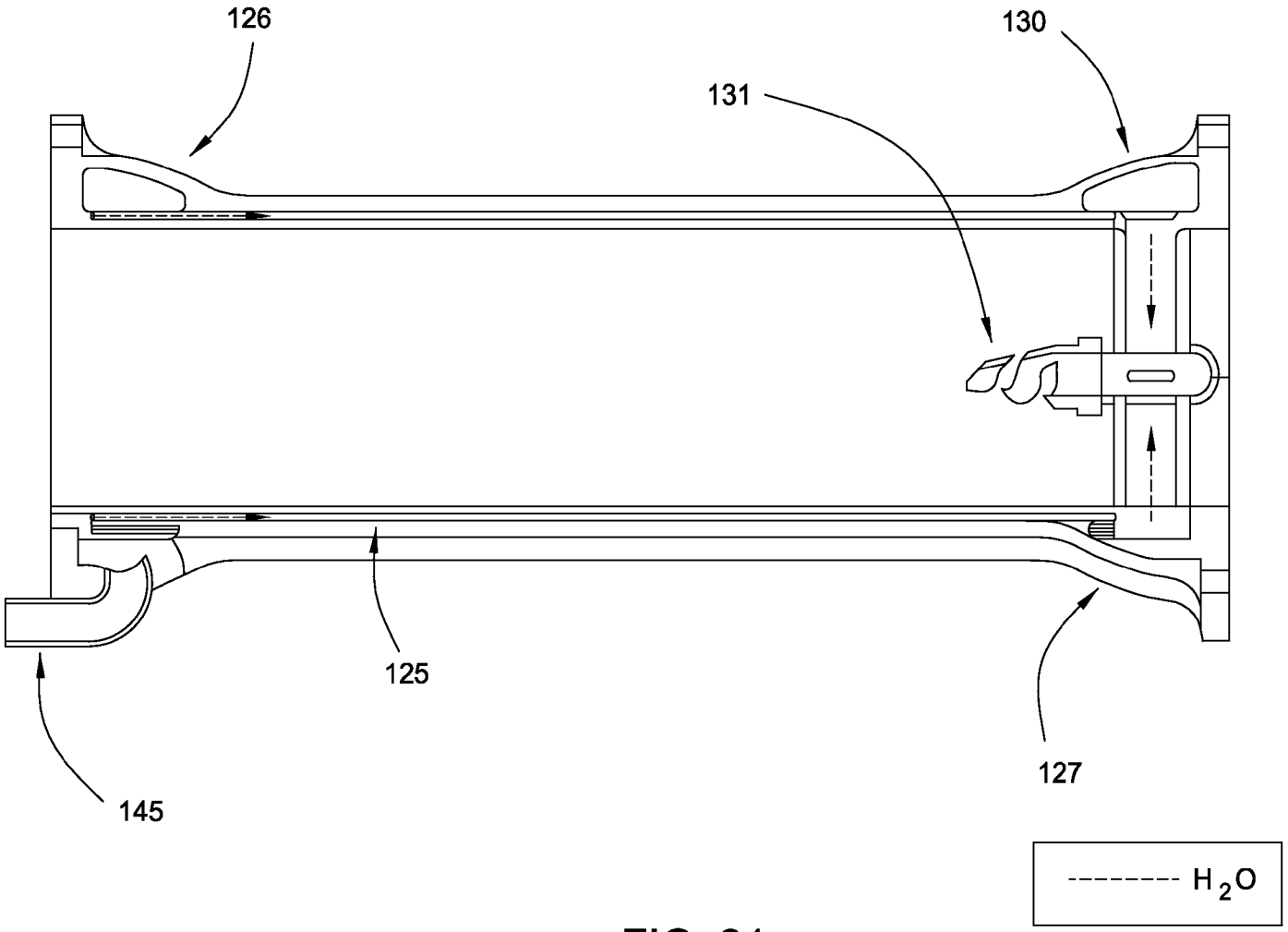

FIGS. 19, 20, and 21 illustrate isometric and cross sectional views of the combustion section 120 and the evaporation section 130. The combustion section 120 includes a liner 121 forming a combustion chamber and a pair of flanged ends 122 and 123, each end having a manifold 126 and 127 disposed therein. The combustion section 120 and the evaporation section 130 are formed and operate in a similar manner as the combustion section 30 and the evaporation section 40 described above with respect to the DHSG 10, which will not be repeated for brevity. Also illustrated is a feed tube 145 coupled to the flanged end 122 of the liner 121 for supplying a fluid, such as a cooling fluid, such as liquid water, to the manifold 126, then to one or more cooling channels 125 disposed along the longitudinal length of the walls of the liner 121, then to the manifold 127 (which is in fluid communication with the evaporation section) to facilitate thermal control of the DHSG 100 and the production of partially saturated, fully saturated, or superheated steam via the injector 131 of the evaporation section 130. In one embodiment, the feed tube 145 may be formed from a metallic material, such as a nickel-cobalt alloy, such as Haynes 230. In one embodiment, components of the injection section 110, the combustion section 120, and the evaporation section 130 may be formed from a metallic material, such as a beryllium-copper alloy. In one embodiment, the injector 131 may be formed from a metallic material, such as a nickel-cobalt alloy, such as Haynes 230.

The DHSG 10 and 100 described above may include multiple combustion chambers. In one embodiment, the multiple combustion chambers may be positioned in series or in a parallel configuration. Each combustion chamber may share a liner with one or more other combustion chambers and/or may include a single liner. In one embodiment, the DHSG 10 and 100 may include a variety of multiple injection, combustion, and evaporation section configurations described above.

In one embodiment, one or more fluids, including but not limited to water, natural gas, oxygen, air, rich air, carbon dioxide, nitrogen, hydrogen, inert gases, hydrocarbons, oxygenated-hydrocarbons, and combinations thereof may be supplied from the surface to the DHSG via one or more tubular members, such as umbilicals. The one or more fluids may be supplied to the DHSG simultaneously and/or in a staged fashion depending on the desired operation. In one embodiment, the one or more fluids, including but not limited to carbon dioxide, nitrogen, hydrogen, and/or inert gases may be used to control (lower) the temperature of the DHSG or a liner/combustion chamber of the DHSG, transmit incremental heat from the DHSG to an oil reservoir, and improve oil recovery by dissolving into the oil, thereby upgrading the oil and decreasing its viscosity. In one embodiment, carbon dioxide, nitrogen, and/or other inert gases may be simultaneously injected with steam using the DHSG. In one embodiment, hydrogen may be simultaneously injected with steam using the DHSG. In one embodiment, the DHSG may be configured to inject other materials (liquids, gases, solids) that complement steam and provide in-situ upgrading. In one embodiment, the other materials may include nanocatalysts, surfactants, solvents, etc. In one embodiment, the DHSG may be operable to maintain and/or adjust the pressure and flow rates of fluids/materials flowing through the DHSG in real time to optimize reservoir production and process economics.

In one embodiment, steam, excess oxygen (including air or enriched air), carbon dioxide, nitrogen, and/or hydrogen may be simultaneously injected into the oil reservoir via the DHSG to generate incremental heat and a controlled independent steam front. In-situ oxidation (combustion) of the oil reservoir's bypassed residual oil may generate more heat and more steam downhole. The DHSG may be configured to generate and manage stable in-situ oxidation through the addition of surplus oxygen and external high pressure steam. The large, stable incremental steam front may yield more heat for more oil combustion. In one embodiment, surplus pressurized oxygen and high quality steam may be injected directly to the oil reservoir using the DHSG. Residual oil that may be left behind the initial steam front may support and accelerate combustion of the surplus oxygen, thereby creating a combustion front. The combustion front may increase the temperature of the steam front, and may heat and/or vaporize water present in the reservoir to generate another large, stable steam front which can accelerate oil production. In one embodiment, the initial steam front may heat the oil ahead of the in-situ combustion to ensure that all surplus oxygen reacts in the reservoir and prevent non-combusted oxygen breakthrough into the production wells, thereby improving safety and decreasing potential corrosive effects to infrastructure.

In one embodiment, the DHSG may be used to combust natural gas and thereby produce carbon dioxide, which is injected into and remains in the oil reservoir (sequestration). In one embodiment, the carbon dioxide produced from a production well may be recycled and reused for DHSG cooling and/or enhanced reservoir production. In one embodiment, the carbon dioxide produced from a production well may be sold and/or used for other types of operations.

In one embodiment, the reservoir pressure may be maintained and controlled at the production well using a pressure control device to "throttle" the produced fluid stream to maintain "back pressure". The reservoir pressure may also be maintained and controlled using the DHSG by injecting fluids at the injection well. The use of two pressure control points may provide better reservoir management, promote gas solubility in the oil for less viscous oil and accelerated recovery, improve the gas-oil-ratio (GOR) which in turn reduces the oil's viscosity ahead of the steam front and accelerates production, prevents premature gas production, which detracts from oil production and may increase operating costs if not managed. In addition, gas injection reduces the partial pressure of steam and causes it to condense deeper in the oil reservoir, so that heat transfer improves and oil production increases. In one embodiment, the recovered fluids at the production well may be controlled (e.g. limited) so that the injection pressure is maximized within the oil reservoir formation. Maintaining a high reservoir pressure may provide high-flowing back pressure on the production well, high solubility of carbon dioxide in the cold oil ahead of the steam front, and high condensation temperature of the steam which in turn assures high solubility of water in the hot oil. This combination of effects reduces the oil's viscosity, limits or prohibits oxygen breakthrough, and increases pyrolysis of the oil in the reservoir thereby increasing its API gravity and reducing its sulfur content.

In one embodiment, one or more tubular members or bundled conduits, such as umbilicals, may be used to transmit electric power, fluids, gases and/or communication signals from surface equipment to one or more components of the DHSG. In one embodiment, the tubular members may include wires and/or pipes bundled within a larger reinforced encasement, including insulation. In one embodiment, one or more umbilicals may be used to deliver water, oxygen, nitrogen, carbon dioxide, fuel, and/or other gases and fluids from surface equipment to the DHSG. In one embodiment, the umbilicals may include control lines from surface equipment to the DHSG.

In one embodiment, one or more (automated) control systems and/or sensors may be used to provide real time control/monitoring of the DHSG and the reservoir production. A control system may be operable to reduce the effects of lag times, and monitoring and managing DHSG operations several hundreds and/or thousands of feet below the surface control elements. The control system may include all aspects of safe, reliable operations across all potential operating conditions and anomalies, including automatic shut down of the DHSG as required. In one embodiment, one or more components including flowmeters, high temperature fiber optic monitoring (to monitor steam distribution in real time), high temperature gauges and valves for downhole monitoring, and high pressure and temperature sensors, thermocouples, and transducers may be used with the DHSG to measure and monitor one or more operational characteristics.

In one embodiment, one or more support devices, such as packers, may be used to support DHSG equipment to a specified position in the wellbore casing or tubular and to provide a pressure seal. The packers may have a mandrel so that tubing can be run within the length of the packer. In one embodiment, one or more packers may be used to support the weight of the DHSG, tubulars and the tailpipe. The output from the tailpipe of the DHSG may be disposed through the mandrel in the packer to be injected into the oil reservoir. In one embodiment, the packer may be operable at high temperatures of up to 680 degrees Fahrenheit.

In one embodiment, one or more artificial lift systems may be used with the DHSG system to provide incremental pumping power to lift fluids from the reservoir, including oil, water, sand, etc. to the surface for separation. An artificial lift system may be used with a light oil diluent stream (which is pumped into the production well, resulting in a lower viscosity blended oil mixture) for easier pumping. Artificial lift systems may include progressive cavity pumps and electrical submersible pumps.

In one embodiment, a variety of other fit-for-purpose equipment and services may be used with the DHSG system, including but not limited to specific drilling fluids (SAGD drilling fluids), well placement devices (inclination and gamma ray, high temperature logging tools, measuring while drilling tools, logging while drilling tools, sand screens (to improve tolerance of ESP pumps), and equalizer technology for more efficient sweep of the formation by the injected steam, high temperature valves, and high temperature thermocouple systems.

While the foregoing is directed to embodiments of the invention, other and further embodiments of the invention may be devised without departing from the basic scope thereof, and the scope thereof is determined by the claims that follow.

The invention claimed is:

1. A method for recovering hydrocarbons, comprising:

injecting a fluid into a reservoir using a downhole steam generator that is disposed in an injection well;

recovering hydrocarbons from the reservoir through a production well; and controlling pressure in the reservoir by maintaining a back pressure in the production well using a pressure control device that is in communication with the production well and by adjusting at least one of pressure and flow at which the fluid is injected into the reservoir by the downhole steam generator.

2. The method of claim 1, wherein the back pressure in the production well is maintained by throttling a hydrocarbon stream flowing through the production well using the pressure control device.

3. The method of claim 1, further comprising controlling pressure in the reservoir by adjusting a flow rate of the fluid injected into the reservoir by the downhole steam generator.

4. The method of claim 1, further comprising recovering carbon dioxide from the reservoir through the production well, and injecting the recovered carbon dioxide into the reservoir using the downhole steam generator.

5. The method of claim 1, wherein the fluid injected into the reservoir comprises at least one of steam, oxygen, carbon dioxide, nitrogen, and hydrogen.

6. The method of claim 1, wherein the fluid injected into the reservoir comprises oxygen, and further comprising initiating in-situ combustion of the hydrocarbons and oxygen within the reservoir.

7. The method of claim 1, further comprising recovering hydrocarbons from the reservoir through the production well using a pump.

8. The method of claim 7, further comprising injecting a diluent into the production well to facilitate recovering of the hydrocarbons using the pump.

9. The method of claim 1, wherein the downhole steam generator is supported within the injection well using a packer.

10. The method of claim 1, further comprising transmitting at least one of liquids, gases, and electronic signals between the surface and the downhole steam generator using an umbilical member.

11. The method of claim 1, further comprising monitoring reservoir conditions using a sensor disposed in at least one of the injection well and production well.

12. The method of claim 1, further comprising monitoring one or more operational characteristics of the downhole steam generator using a surface control system.

13. A method for recovering hydrocarbons, comprising:

injecting a fluid into a reservoir using a downhole steam generator that is disposed in an injection well;

recovering hydrocarbons from the reservoir through a production well using a pump;

injecting a diluent into the production well to facilitate recovering of the hydrocarbons using the pump; and controlling pressure in the reservoir by maintaining a back pressure in the production well using a pressure control device that is in communication with the production well.

* * * * *